US010933645B2

(12) United States Patent
Takakura

(10) Patent No.: US 10,933,645 B2
(45) Date of Patent: Mar. 2, 2021

(54) PRINTER AND CARTRIDGE

(71) Applicant: SEIKO EPSON CORPORATION, Tokyo (JP)

(72) Inventor: Ryusuke Takakura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/727,260

(22) Filed: Dec. 26, 2019

(65) Prior Publication Data

US 2020/0207106 A1 Jul. 2, 2020

(30) Foreign Application Priority Data

Dec. 28, 2018 (JP) ..... JP2018-246578

(51) Int. Cl.
*B41J 2/175* (2006.01)

(52) U.S. Cl.
CPC ..... *B41J 2/17523* (2013.01)

(58) Field of Classification Search
CPC ..... B41J 2/17523
See application file for complete search history.

(56) References Cited

U.S. PATENT DOCUMENTS

2003/0067520 A1* 4/2003 Inoue ..... B41J 2/17503 347/86
2007/0296775 A1 12/2007 Lee et al.
2018/0272741 A1* 9/2018 Kobayashi ..... B41J 2/17536

FOREIGN PATENT DOCUMENTS

| | | |
|---|---|---|
| CN | 101096144 | 1/2008 |
| CN | 202573288 | 12/2012 |
| JP | 2016-088065 | 5/2016 |
| WO | 2007/142263 | 6/2007 |

* cited by examiner

*Primary Examiner* — Lamson D Nguyen
(74) *Attorney, Agent, or Firm* — Workman Nydegger

(57) ABSTRACT

A printer includes a cartridge is mounted in a cartridge holder, an needle-tube having an ink flow path, an protrusion disposed around the needle-tube as viewed from an axial direction of the needle-tube, and an elastic-member configured to be deformed in a direction from a tip end to a base end of the needle-tube, in which the elastic-member changes a relative positional relationship between a tip end position of the needle-tube and a tip end position of the protrusion from a first state in which the tip end position of the protrusion is located further away from the base end of the needle-tube than is the tip end position of the needle-tube, to a second state in which the tip end position of the protrusion is closer to the base end of the needle-tube than is the tip end position of the needle-tube upon being deformed by an external force.

9 Claims, 21 Drawing Sheets

PRINTER AND CARTRIDGE

The present application is based on, and claims priority from JP Application Serial Number 2018-246578, filed Dec. 28, 2018, the disclosure of which is hereby incorporated by reference herein in its entirety.

BACKGROUND

1. Technical Field

The present disclosure relates to a printer and a cartridge.

2. Related Art

An ink jet printer on which cartridges that house ink are replaceably mounted is known. JP-A-2016-088065 discloses an ink jet storage device configured such that a hollow ink lead-out member is inserted into an ink lead-out port of a cartridge to lead out ink in the cartridge. The ink lead-out port of the cartridge is sealed with a film in order to prevent, for example, ink leakage. For this reason, the ink lead-out member described in JP-A-2016-088065 has a shape in which the tip end is narrowed in order to tear the film.

In addition, when the ink lead-out member is inserted into the ink lead-out port, a portion of the torn film may enter the inside of the ink lead-out port with the insertion of the ink lead-out member. As a result, ink leakage or the like may occur. Therefore, in JP-A-2016-088065, for the purpose of preventing the torn film from entering the ink lead-out port, the tip end of the ink lead-out member has a shape having two protrusions, and the length of the torn film is shorter than that of a torn film in the related art.

The film is likely to bend due to the influence of the manufacturing conditions, the temperature, the internal pressure of the cartridge, and the like, and, in addition, there are individual differences in the degree of bending. In the ink lead-out member described in JP-A-2016-088065, when the deflection of the film increases, the tear position of the film tends to shift from the desired position. When the tear position of the film is shifted from the desired position, a long portion and a short portion of the torn pieces of the torn film are formed, and the long portion may enter the ink lead-out port. For this reason, the ink jet storage device in the related art has a problem that it cannot sufficiently suppress the occurrence of problems such as ink leakage.

SUMMARY

According to an aspect of the disclosure, a printer includes a cartridge holder in which a cartridge that houses ink is mounted, an needle tube having an ink flow path through which the ink is introduced from the cartridge, an protrusion disposed around the needle tube as viewed from an axial direction of the needle tube, and an elastic member configured to be deformed by an external force in a direction from a tip end to a base end of the needle tube, in which the elastic member changes a relative positional relationship between a tip end position of the needle tube and a tip end position of the protrusion from a first state in which the tip end position of the protrusion is located further away from the base end of the needle tube than is the tip end position of the needle tube, to a second state in which the tip end position of the protrusion is closer to the base end of the needle tube than is the tip end position of the needle tube upon being deformed by the external force.

According to another aspect of the disclosure, a cartridge attachable to a printer having an needle tube having an ink flow path into which ink is introduced, includes an ink container that houses the ink and that is provided with an opening portion through which the needle tube is configured to be inserted, a sealing film disposed outside the opening portion and sealing the opening portion, an annular support portion that is disposed inside the opening portion and in which the needle tube is inserted and supported, and an annular portion that is disposed in a region between the support portion and the sealing film inside the opening portion and that has an opening width larger than an opening width of the support portion.

DESCRIPTION OF EXEMPLARY EMBODIMENTS

Figure 1:
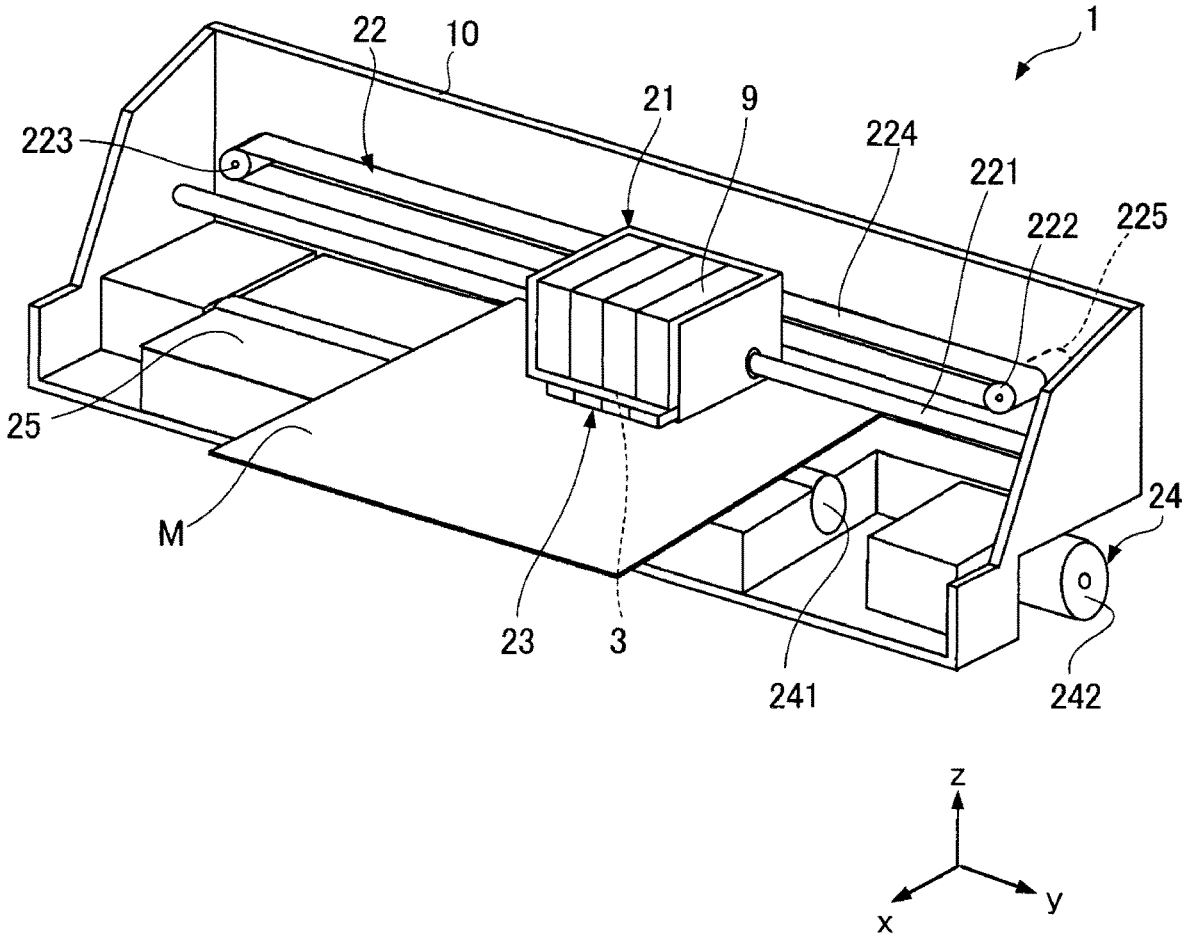
FIG. 1 is a perspective view illustrating an internal structure of a printer of a first embodiment.

Hereinafter, preferred embodiments of the present disclosure will be described with reference to the accompanying drawings. Further, in the drawings, the dimensions and scales of elements are appropriately different from the actual ones, and some elements are schematically illustrated for easy understanding. In addition, the scope of the present disclosure is not limited to these embodiments unless otherwise specified in the following description.

1. First Embodiment

1-1. Overall Configuration of Printer 1

FIG. 1 is a perspective view illustrating an internal structure of a printer 1 according to a first embodiment. Further, in the following description, for convenience of description, the x axis, the y axis, and the z axis that are perpendicular to each other and illustrated in FIG. 1 will be used as appropriate. In the following, the direction of the arrow on the z axis is the +z direction, which corresponds to the "upper side", and the direction opposite to the arrow on the z axis is the −z direction, which corresponds to the "lower side".

The printer 1 illustrated in FIG. 1 is an ink jet printer, and ejects ink onto a medium M such as paper. The printer 1 includes a carriage 21, a movement mechanism 22, an ink supply unit 3, a print head 23, and a transport mechanism 24.

The carriage 21 is an example of a "cartridge holder" on which a plurality of cartridges 9 that house ink can be mounted, and can be moved by the movement mechanism 22. In the figure, four cartridges 9 corresponding to four colors of yellow, cyan, magenta, and black are mounted on the carriage 21.

The movement mechanism 22 reciprocates the carriage 21 in the +y direction and the −y direction. The movement mechanism 22 includes a guide shaft 221, a first pulley 222, a second pulley 223, a timing belt 224, and a carriage motor 225. The guide shaft 221 extends in the +y direction, and both ends thereof are fixed to a support member 10 disposed inside the casing of the printer 1. The timing belt 224 is bridged between the first pulley 222 and the second pulley 223. The timing belt 224 extends substantially parallel to the guide shaft 221. The first pulley 222 is driven by the carriage motor 225 so as to rotate. Further, the carriage motor 225 is driven by a motor driver (not illustrated).

The carriage 21 is supported by the guide shaft 221 so as to be capable of reciprocating and is fixed to a portion of the timing belt 224. Therefore, when the timing belt 224 is reciprocated by the carriage motor 225, the carriage 21 reciprocates while being guided by the guide shaft 221.

In addition, the ink supply unit 3 is coupled to the carriage 21. The ink supply unit 3 supplies the ink housed in the cartridges 9 to the print head 23. The print head 23 is disposed below the carriage 21. Although not illustrated, the print head 23 includes a plurality of nozzles, and ejects ink to the medium M positioned below the print head 23.

The medium M is transported by the transport mechanism 24. The transport mechanism 24 includes a transport roller 241 and a transport motor 242. The transport roller 241 is rotationally driven by the transport motor 242 that is a drive source. Further, the transport motor 242 is driven by a motor driver (not illustrated). In addition, a platen 25 is disposed below the carriage 21.

The medium M is transported in the +x direction between the carriage 21 and the platen 25 by the transport roller 241. Then, ink is applied to the medium M by the print head 23.

1-2. Cartridge 9 and Ink Supply Unit 3

Figure 2:
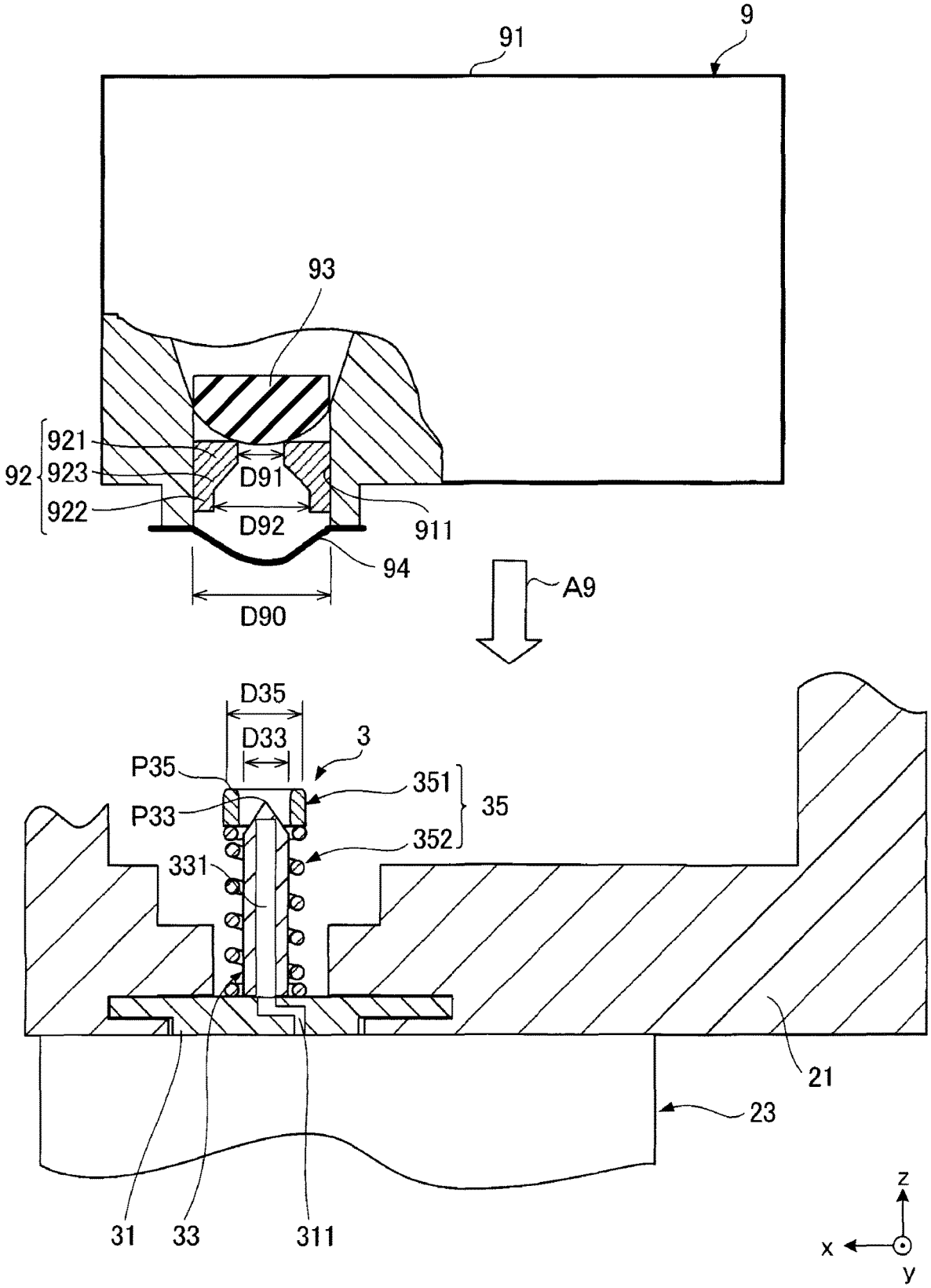
FIG. 2 is a sectional view illustrating a state where the cartridge of the first embodiment is not mounted on a carriage.

FIG. 2 is a sectional view illustrating a state in which the cartridge 9 of the first embodiment is not mounted on the carriage 21. The cartridge 9 is attached to the carriage 21 by being pressed in the arrow A9 direction from the state illustrated in FIG. 2. Hereinafter, the configuration of the cartridge 9 and the ink supply unit 3 will be described.

Cartridge 9

As illustrated in FIG. 2, the cartridge 9 includes an ink container 91, an elastic member 92, a valve body 93, and a sealing film 94.

The ink container 91 is a container that houses ink, and has a substantially rectangular parallelepiped shape in the present embodiment. Further, the shape of the ink container 91 is not limited to the illustrated example. In addition, the ink container 91 is provided with an opening portion 911 for leading out ink. The opening portion 911 is a through hole formed in the ink container 91 and communicates with the inside and outside of the ink container 91.

The elastic member 92 is disposed inside the opening portion 911 of the ink container 91. The elastic member 92 has an annular shape, and its outer peripheral surface is in contact with the wall surface of the opening portion 911. The elastic member 92 includes a first portion 921, a second portion 922, and a third portion 923 positioned between the first portion 921 and the second portion 922. The first portion 921 is located closer to the +z axis side than is the second portion 922, that is, the first portion 921 is located on the inner side of the ink container 91. The opening width D91 of the first portion 921 is smaller than the opening width D92 of the second portion 922. The opening width of the third portion 923 gradually increases from the first portion 921 toward the second portion 922.

The valve body 93 is located on the +z axis side with respect to the elastic member 92, that is, on the inner side of the ink container 91. The valve body 93 prevents the ink in the ink container 91 from flowing out from the opening portion 911 in a state where the cartridge 9 is not mounted on the carriage 21.

The sealing film 94 seals the opening portion 911 of the ink container 91. The sealing film 94 is bonded to the outer wall surface of the ink container 91 so as to close the opening portion 911. By providing the sealing film 94, it is possible to prevent the ink in the ink container 91 from leaking out or the outside air from flowing into the ink container 91. Examples of the constituent material of the sealing film 94 include a resin material and a metal material. For example, the sealing film 94 is a multilayer body including a layer containing a polystyrene resin, a layer containing aluminum, and a layer containing cellophane.

Ink Supply Unit 3

As illustrated in FIG. 2, the ink supply unit 3 is disposed on the bottom surface of the carriage 21. Further, a portion or all of the ink supply unit 3 may be integrated with the carriage 21 or may be disposed on the side surface of the carriage 21. In addition, the installation location of the ink supply unit 3 is determined according to the arrangement of the opening portion 911 in the cartridge 9 and the like, and is not limited to the illustrated example and is arbitrary. In addition, the ink supply unit 3 may, for example, be disposed apart from the carriage 21.

The ink supply unit 3 illustrated in FIG. 2 includes a base body 31, an needle tube 33, and an outer peripheral member 35. The base body 31 is coupled to the carriage 21. The base body 31 has a flow path 311 through which ink flows.

The needle tube 33 protrudes from the base body 31. The needle tube 33 is an ink supply needle that supplies ink in the cartridge 9 to the print head 23. The needle tube 33 is a hollow needle and has an ink flow path 331 through which ink flows. The ink flow path 331 communicates with the print head 23 via the flow path 311 of the base body 31.

The width D33 of the needle tube 33 is smaller than the opening width D90 of the opening portion 911 of the cartridge 9 described above. Therefore, the needle tube 33 can be inserted into the opening portion 911. In addition, the width D33 of the needle tube 33 is equal to or larger than the opening width D91 of the first portion 921 of the elastic member 92. The first portion 921 described above functions as a "support portion" in which the needle tube 33 can be inserted and supported. Here, in a state where the needle tube 33 is inserted into the first portion 921, the first portion 921 is elastically deformed as necessary, and the liquid tightness between the first portion 921 and the needle tube 33 is secured. Further, the opening width D92 of the second portion 922 is larger than the width D33 of the needle tube 33. Therefore, the needle tube 33 can be inserted into the second portion 922.

The outer peripheral member 35 is disposed on the outer side of the needle tube 33 along the outer periphery of the needle tube 33. The outer peripheral member 35 has a shape extending along the needle tube 33 and protrudes from the base body 31. The outer peripheral member 35 includes an annular member 351 and an elastic body 352.

The annular member 351 is an example of an "protrusion". The annular member 351 is formed of, for example, a metal material or a resin material. The width D35 of the annular member 351 is larger than the opening width D91 of the first portion 921 of the cartridge 9. Therefore, when the needle tube 33 is inserted into the first portion 921, the annular member 351 is not inserted into the first portion 921, and a state where the annular member 351 is positioned closer to the second portion 922 than the first portion 921 is maintained. In addition, the tip end surface of the annular member 351 is planar.

The elastic body 352 is located between the annular member 351 and the base body 31 and is coupled to the annular member 351 and the base body 31. The elastic body 352 is an example of a "elastic member". The elastic body 352 is composed of a compression coil spring, and is deformed by applying a compressive load in the direction of the axis A3 of the needle tube 33. In addition, in a state where a compressive load is not applied to the elastic body 352, as illustrated in FIG. 2, the tip end position P35 of the annular member 351 is closer to the +z axis side than is the tip end position P33 of the needle tube 33.

Figure 3:
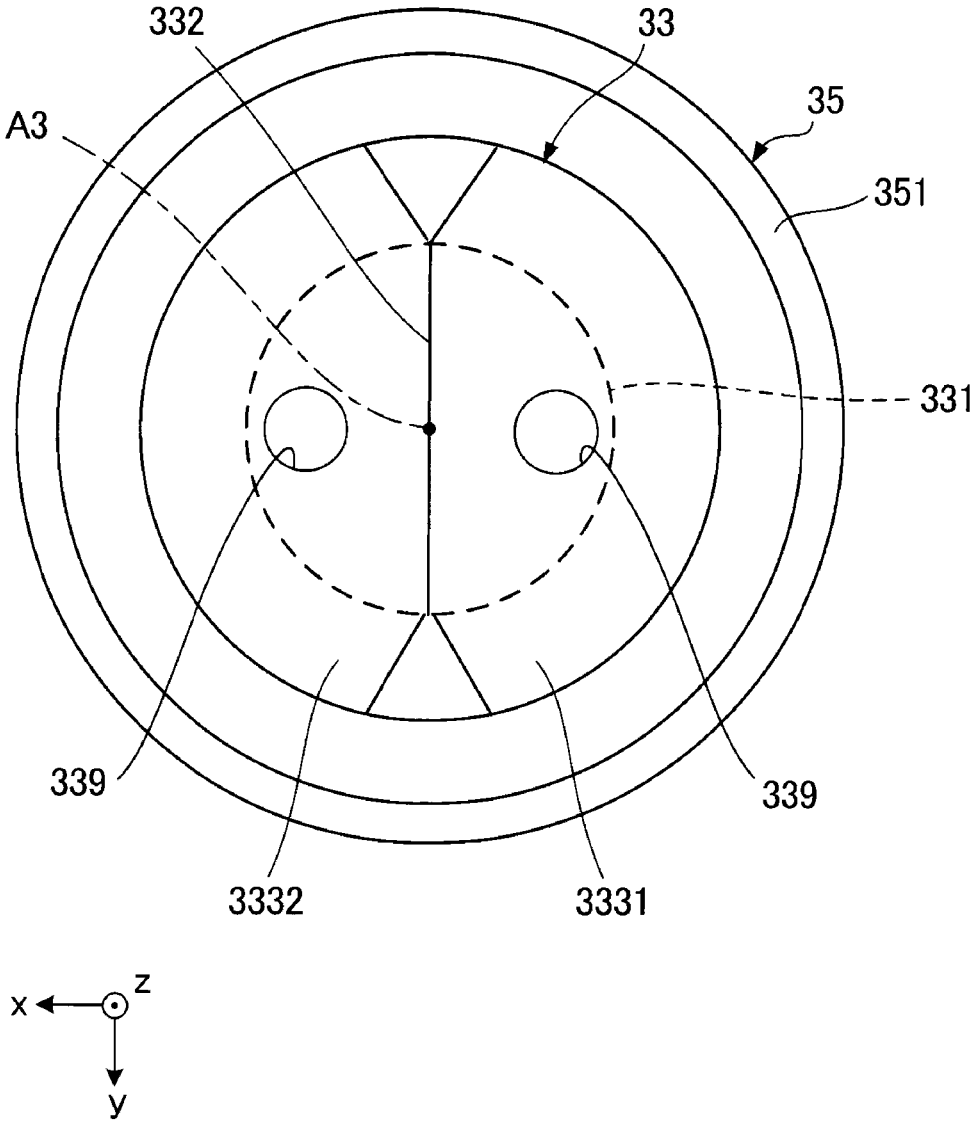
FIG. 3 is a plan view of an needle tube and an outer peripheral member of the first embodiment.

FIG. 3 is a plan view of the needle tube 33 and the outer peripheral member 35 of the first embodiment. As illustrated in FIG. 3, the outer peripheral member 35 surrounds the needle tube 33 as viewed from the +z direction, and is separated from the needle tube 33. Further, the outer peripheral member 35 may be in contact with the needle tube 33.

In addition, the tip end of the needle tube 33 has a ridge line 332. The needle tube 33 has two inclined surfaces 3331 and 3332 that are inclined opposite to each other with respect to the axis A3. The axis A3 in the present embodiment is a center axis along the longitudinal direction of the needle tube 33, that is, the z direction. A coupling portion between the two inclined surfaces 3331 and 3332 is the ridge line 332. The ridge line 332 of the needle tube 33 extends in the +y direction and the −y direction as viewed from the +z direction in the drawing. In addition, the ridge line 332 is perpendicular to the axis A3 extending in the +z direction and the −z direction. In addition, openings 339 communicating with the ink flow path 331 are respectively formed in the two inclined surfaces 3331 and 3332. Further, the number of the openings 339 is not limited to two and may be one or three or more.

Figure 4:
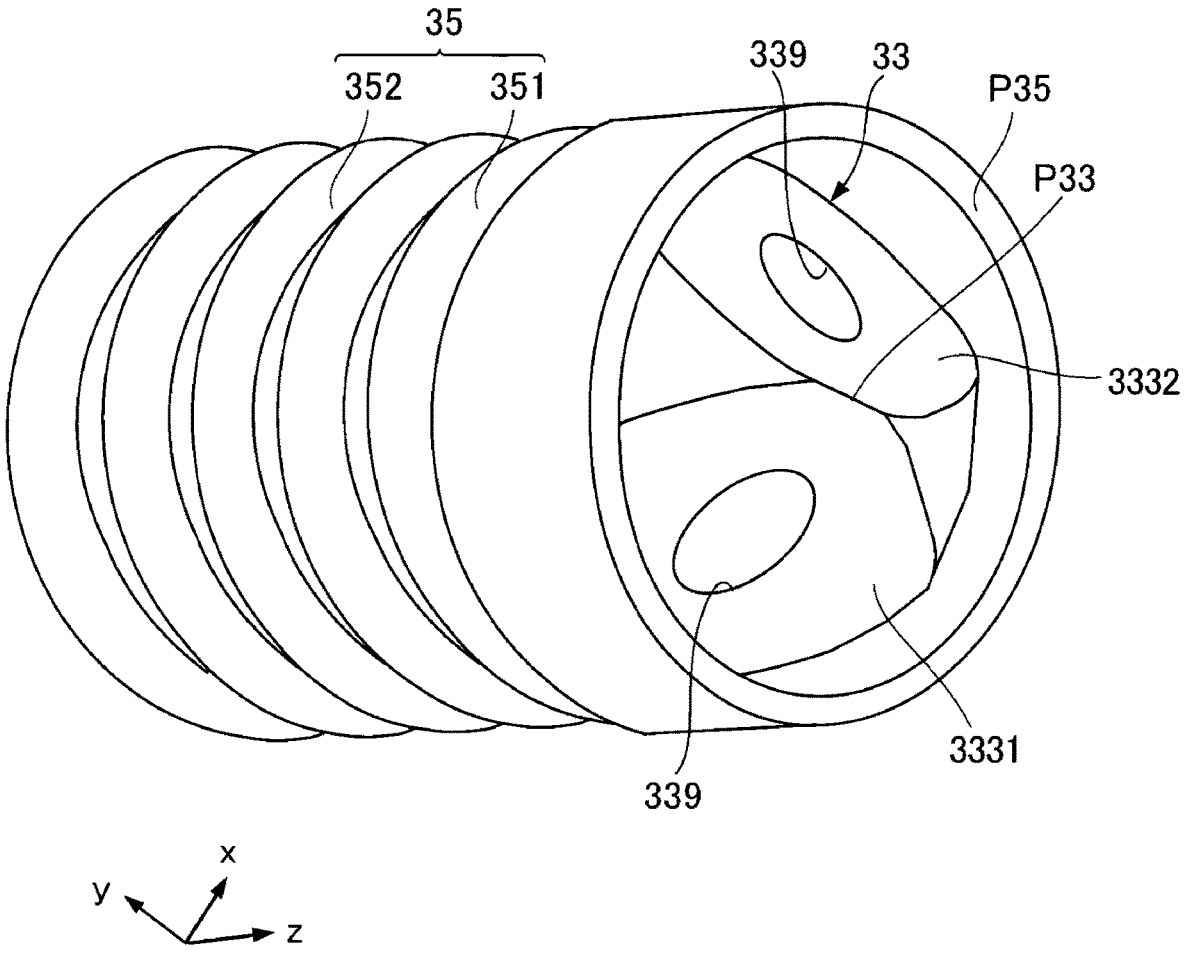
FIG. 4 is a perspective view of an needle tube and an outer peripheral member of the first embodiment.
Figure 5:
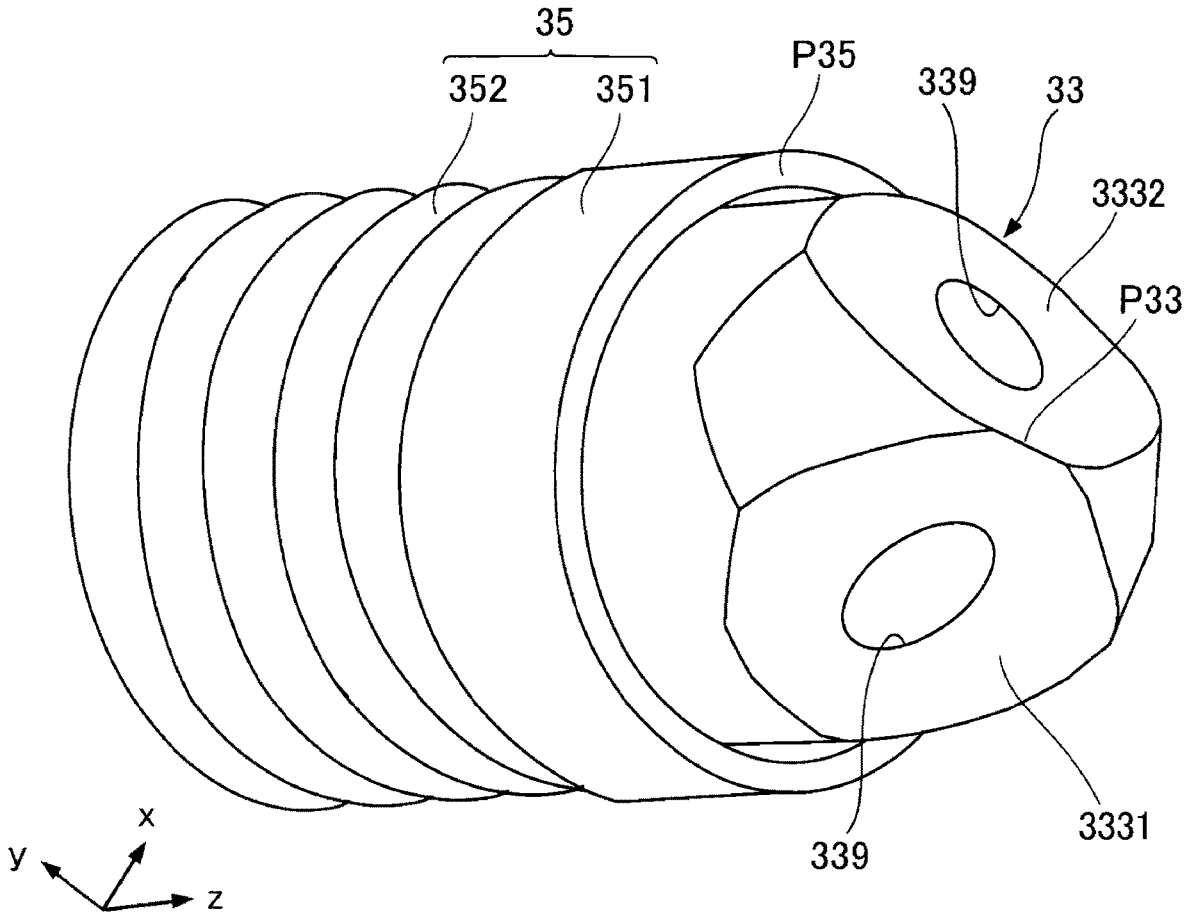
FIG. 5 is a perspective view of an needle tube and an outer peripheral member of the first embodiment.

FIGS. 4 and 5 are perspective views of the needle tube 33 and the outer peripheral member 35 of the first embodiment. The annular member 351 included in the outer peripheral member 35 is movable in the +z direction and the −z direction with the deformation of the elastic body 352 due to the compression load described above. That is, the position of the tip end position P35 of the annular member 351 changes with respect to the tip end position P33 of the needle tube 33 due to the deformation of the elastic body 352. FIG. 4 illustrates a state in which a compressive load is not applied to the elastic body 352. In this state, the tip end position P35 of the annular member 351 is located closer to the +z direction side than is the tip end position P33 of the needle tube 33. On the other hand, FIG. 5 illustrates a state in which a compressive load is being applied to the elastic body 352. In this state, the tip end position P35 of the annular member 351 is located on the −z direction side of the tip end position P33 of the needle tube 33.

Figure 6:
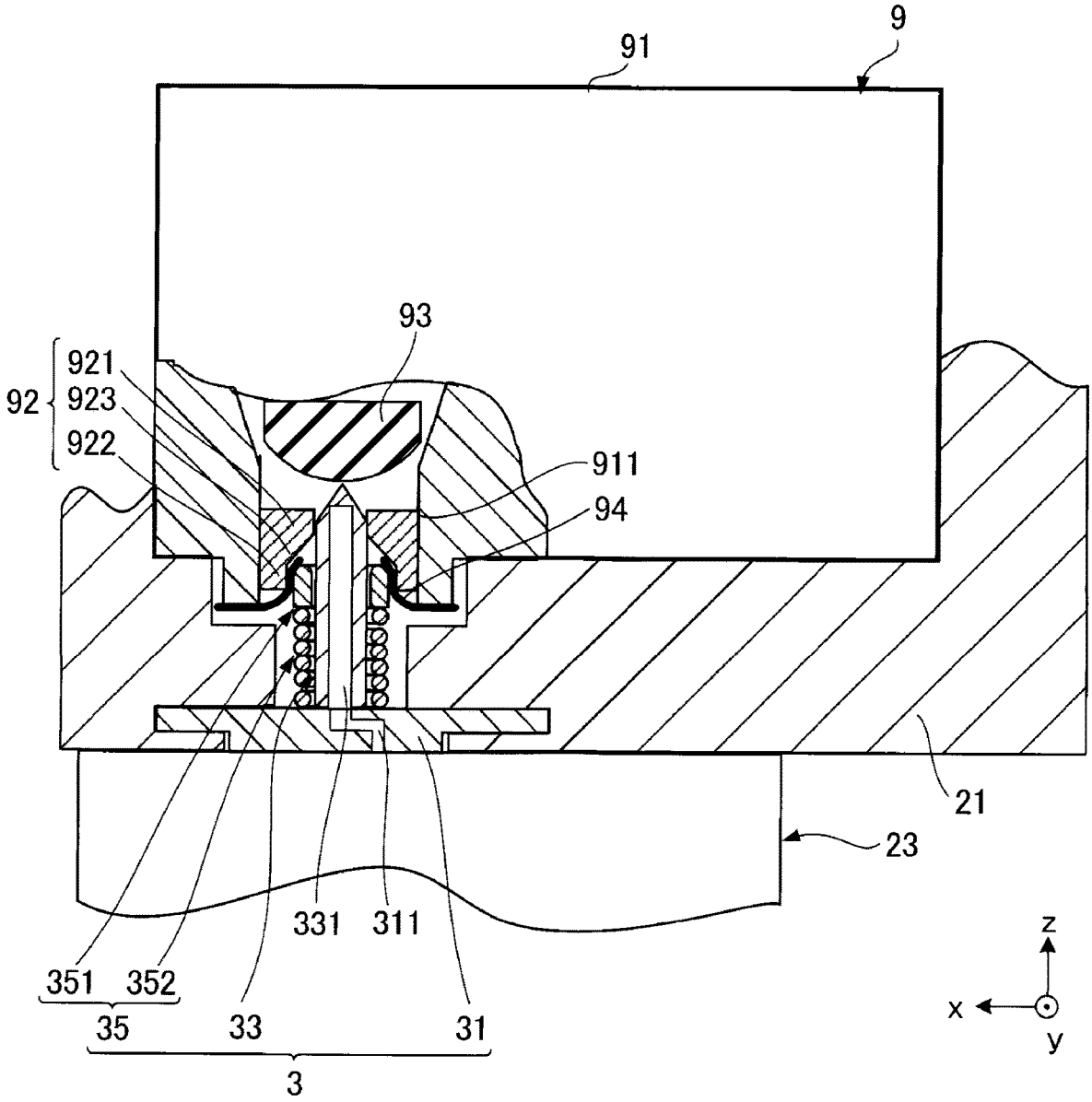
FIG. 6 is a sectional view illustrating a state where the cartridge of the first embodiment is mounted on the carriage.

FIG. 6 is a schematic sectional view illustrating a state in which the cartridge 9 in the first embodiment is mounted on the carriage 21. As illustrated in FIG. 6, when the cartridge 9 is mounted on the carriage 21, the needle tube 33 is inserted into the opening portion 911 of the cartridge 9. Specifically, the needle tube 33 is inserted into the first portion 921 of the elastic member 92 and engages with the first portion 921. Here, the sealing film 94 of the cartridge 9 is torn by the needle tube 33 before the needle tube 33 is inserted into the first portion 921. In addition, the valve body 93 is pushed up in the +z direction by the needle tube 33 when the needle tube 33 is inserted into the first portion 921. When the valve body 93 is pushed up, the ink in the ink container 91 is supplied to the print head 23 through the ink flow path 331 of the needle tube 33.

FIGS. 7 to 10 are sectional views for explaining the mounting of the cartridge 9 on the carriage 21 of the first embodiment. Hereinafter, the mounting of the cartridge 9 on the carriage 21 will be described based on the state of the ink supply unit 3 with reference to FIGS. 7 to 10.

Figure 7:
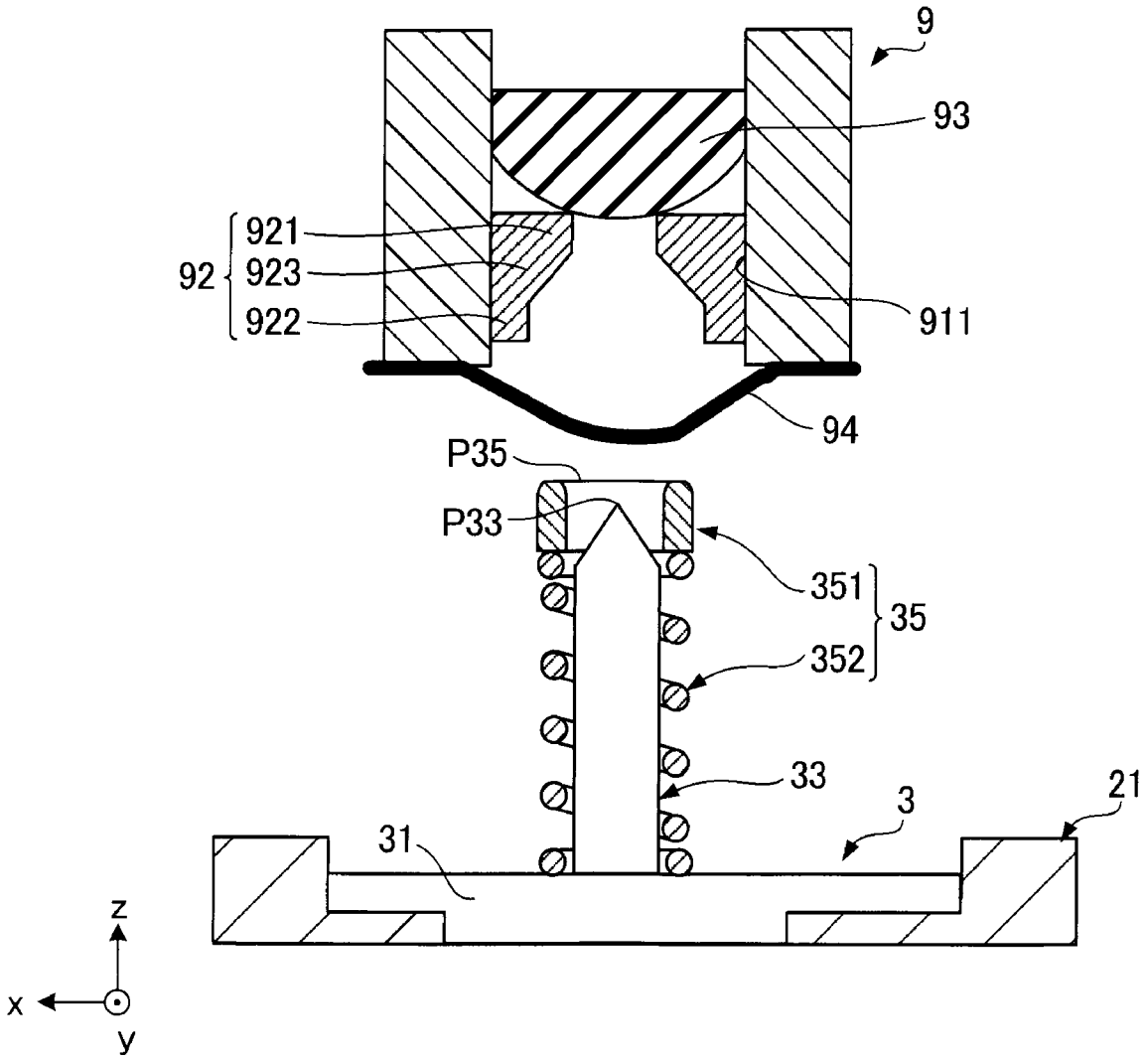
FIG. 7 is a sectional view for explaining mounting of the cartridge on the carriage of the first embodiment.

As illustrated in FIG. 7, when the cartridge 9 is not mounted on the carriage 21, the tip end position P35 of the outer peripheral member 35 of the ink supply unit 3 is located further away from the base body 31 than is the tip end position P33 of the needle tube 33. If the cartridge 9 is moved in the −z direction from the state illustrated in FIG. 7 and is to be mounted on the carriage 21, as illustrated in FIG. 8, the annular member 351 contacts the sealing film 94 of the cartridge 9 before the needle tube 33 does.

Figure 8:
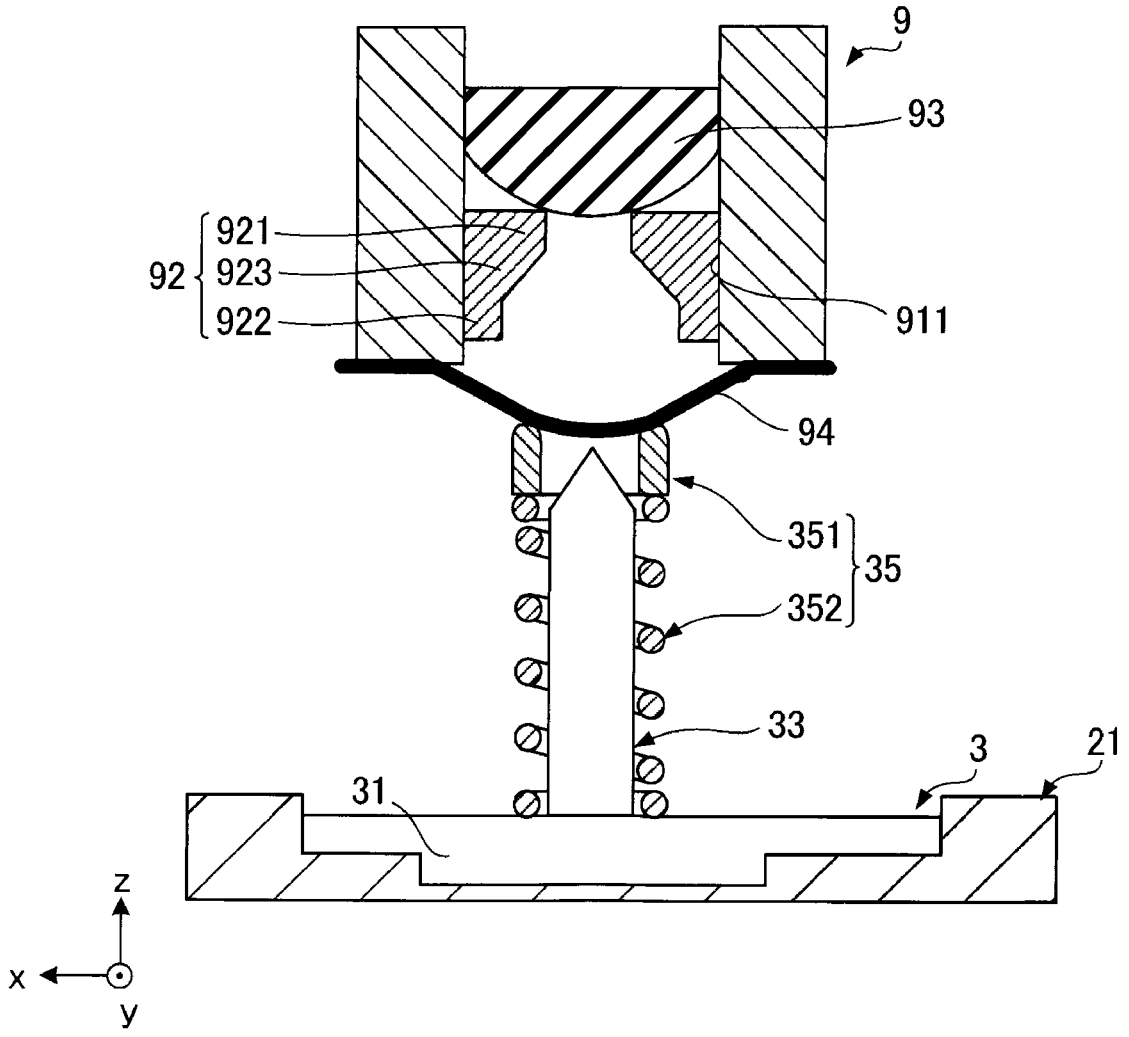
FIG. 8 is a sectional view for explaining the mounting of the cartridge on the carriage of the first embodiment.
Figure 9:
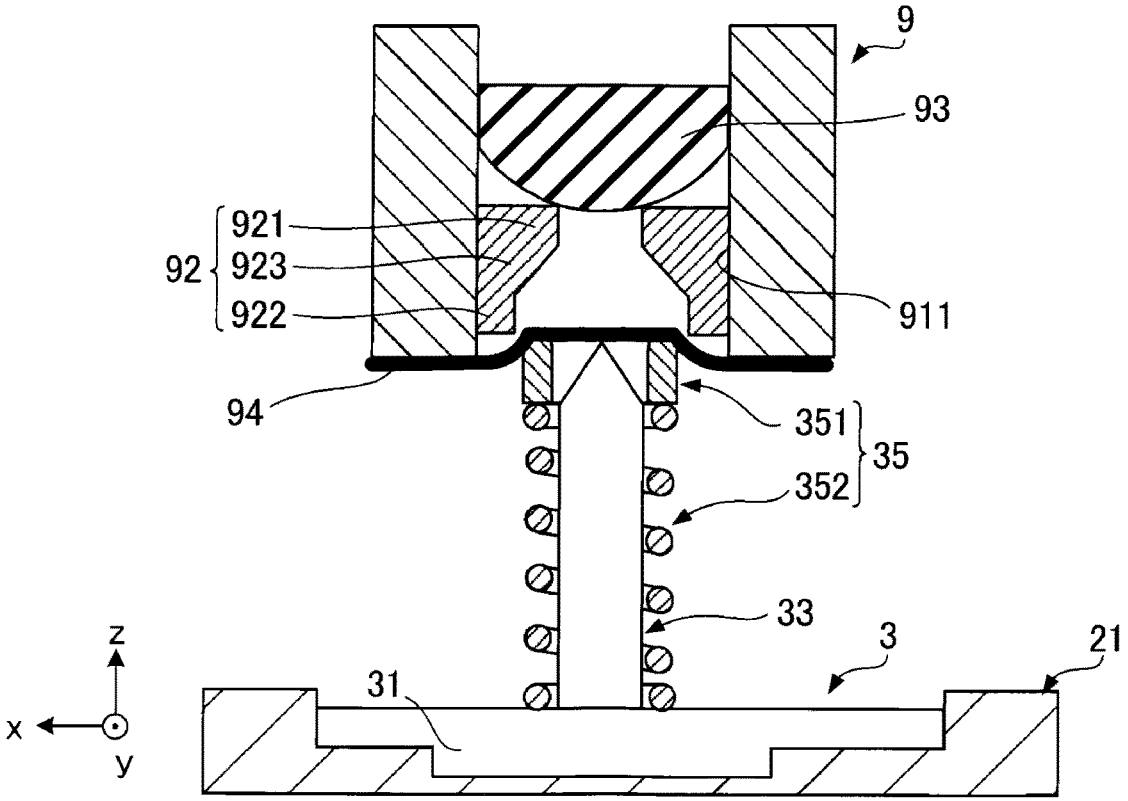
FIG. 9 is a sectional view for explaining the mounting of the cartridge on the carriage of the first embodiment.

As illustrated in FIG. 8, when the cartridge 9 is further moved in the −z direction from the state where the annular member 351 is in contact with the sealing film 94, as illustrated in FIG. 9, the annular member 351 is in close contact with the sealing film 94. At this time, since the annular member 351 is disposed around the needle tube 33, a tension is generated in the sealing film 94 from the center to the outside as viewed from the direction of the axis A3.

In addition, the region inside the annular member 351 in the sealing film 94 becomes planar when viewed from the axis A3 direction. In addition, the above-described compression load is applied to the elastic body 352 by a reaction force applied from the sealing film 94 to the annular member 351. For this reason, the state in which the sealing film 94 is stretched by the above-described tension can be maintained until the reaction force applied from the sealing film 94 to the annular member 351 becomes a predetermined value or more without tearing the sealing film 94.

Figure 10:
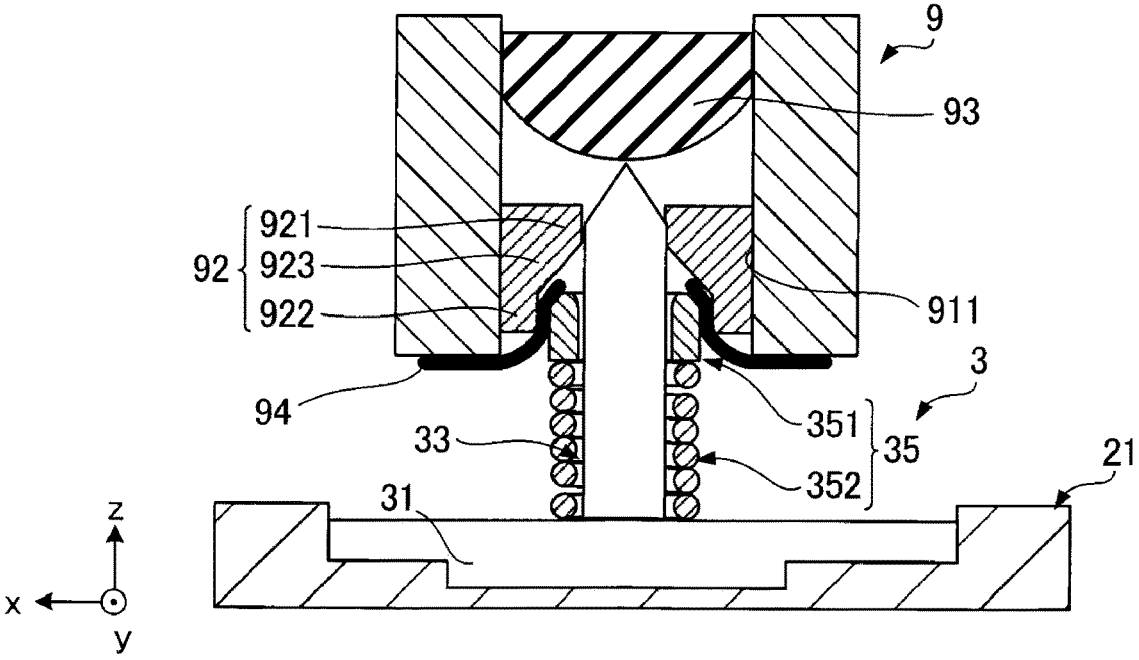
FIG. 10 is a sectional view for explaining the mounting of the cartridge on the carriage of the first embodiment.

As illustrated in FIG. 9, by further moving the cartridge 9 in the −z direction from the state where the sealing film 94 is uniformly stretched, as illustrated in FIG. 10, the elastic body 352 is deformed by the reaction force applied from the sealing film 94 to the annular member 351, and the needle tube 33 protrudes from the annular member 351. Consequently, the sealing film 94 is torn by the needle tube 33. The needle tube 33 is supported by the first portion 921 and pushes the valve body 93 up. The cartridge 9 is mounted on the carriage 21 in the manner described above.

As described above, the printer 1 includes the carriage 21 as a "cartridge holder" in which the cartridge 9 that houses ink is mounted, and the needle tube 33, which has the ink flow path 331 into which the ink is introduced from the cartridge 9. In addition, the printer 1 includes the annular member 351 as an "protrusion" disposed around the needle tube 33 when viewed from the direction of the axis A3 of the needle tube 33. Furthermore, the printer 1 includes the elastic body 352 as a "elastic member" that is deformed by an external force in a direction from the tip end of the needle tube 33 toward the base end of the needle tube 33. The elastic body 352, from a first state where the tip end position P35 is located further away from the base end of the needle tube 33 than is the tip end position P33, is deformed by an external force, and the relative positional relationship between the needle tube 33 and the annular member 351 is changed to a second state in which the tip end position P35 is closer to the base end side of the needle tube 33 than is the tip end position P33.

In the printer 1, when an external force greater than a predetermined value is not applied to the elastic body 352, the tip end position P35 of the annular member 351 can be positioned further away from the base body 31 than is the tip end position P33 of the needle tube 33. Therefore, as described above, the annular member 351 can be brought into contact with the sealing film 94 before the needle tube 33. Since the annular member 351 is disposed around the needle tube 33 as viewed from the direction of the axis A3, the region of the sealing film 94 that the needle tube 33 can contact can be stretched. For this reason, the needle tube 33 can be brought into contact with the sealing film 94 in which tension has been generated. Therefore, the contact position of the needle tube 33 on the sealing film 94 can be stabilized as compared with the case where the needle tube 33 is brought into contact with the sealing film 94 in a state where the sealing film 94 is bent. Therefore, since the sealing film 94 can be torn because stress concentrates at an expected position on the sealing film 94, occurrence of problems such as ink leakage due to the sealing film 94, which has been torn, entering between the first portion 921 and the needle tube 33 can be suppressed.

Figure 11:
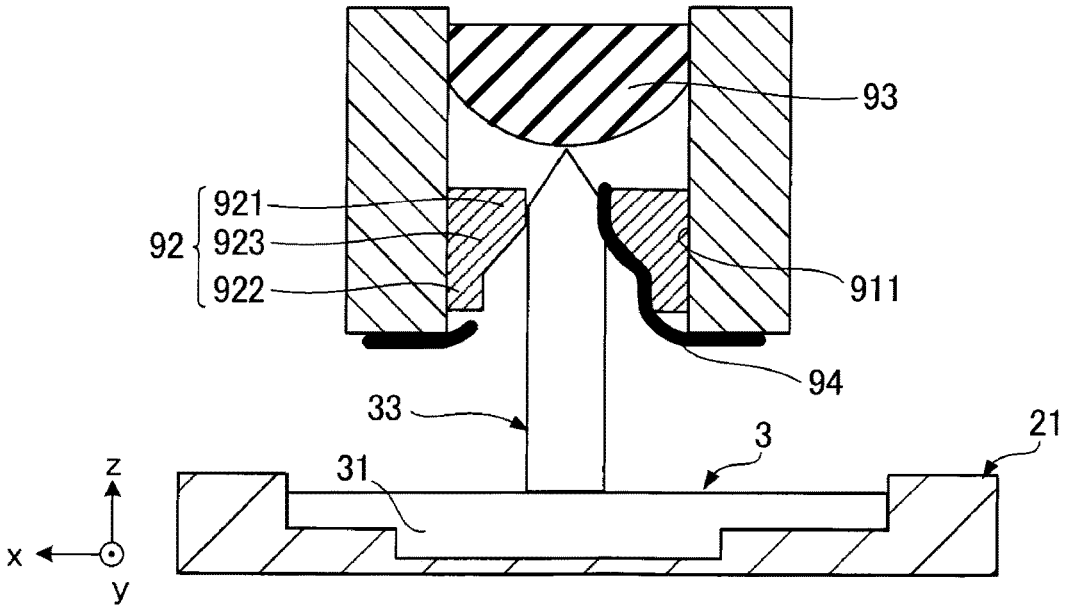
FIG. 11 is a sectional view illustrating an example of a failure caused by a sealing film when no outer peripheral member is provided.

FIG. 11 is a sectional view illustrating an example of a malfunction caused by the sealing film 94 when the outer peripheral member 35 is not provided. As illustrated in FIG. 11, when the outer peripheral member 35 is not provided, the needle tube 33 is brought into contact with the sealing film 94 while the sealing film 94 is in a bent state. Accordingly, the position where the sealing film 94 is torn is not stable. As a result, the torn pieces of the sealing film 94 may be longer than expected. Therefore, the sealing film 94 that has been torn may enter between the first portion 921 and the needle tube 33.

On the other hand, in the present embodiment, as described above, since the sealing film 94 is not bent and is in a stretched state, the needle tube 33 can be brought into contact with the sealing film 94 at an expected position, and the needle tube 33 can be used as a starting point for tearing the sealing film 94. Therefore, the sealing film 94 can be torn as expected, and the above-described problems caused by the sealing film 94 can be suppressed.

In addition, as described above, by deforming the elastic body 352 by an external force in the +z direction, the tip end position P35 can be positioned closer to the base body 31 than is the tip end position P33. For this reason, the needle tube 33 can be inserted into the first portion 921 without being obstructed by the annular member 351.

In addition, as described above, in the present embodiment, the "elastic member" is constituted by the elastic body 352. For this reason, the sealing film 94 can be in a state of being stretched with sufficient tension without being torn by the elastic force of the elastic body 352. For this reason, since the cutting position of the sealing film 94 can be made more stable, the sealing film 94 can be torn as expected, and problems caused by torn pieces of the sealing film 94 can be further suppressed.

Furthermore, as described above, the annular member 351 surrounds the needle tube 33 over the entire circumference when viewed from the direction of the axis A3. For this reason, compared with the case where the annular member 351 does not surround the circumference of the needle tube 33, the portion of the sealing film 94 positioned closer to the inside than is the annular member 351 as viewed from the direction of the axis A3 can be more uniformly stretched. Therefore, it becomes easier to form the starting point of the tearing of the sealing film 94 with the needle tube 33. In addition, since a tension having a direction component perpendicular to the direction in which the ridge line 332 of the needle tube 33 extends is applied to the sealing film 94, there is an advantage that the sealing film 94 can be easily torn by the needle tube 33.

In addition, the elastic body 352 is coupled to the annular member 351. More specifically, the carriage 21 and the annular member 351 are coupled via the elastic body 352. For this reason, the annular member 351 can be moved relative to the carriage 21 by the deformation of the elastic body 352. Therefore, for example, compared with the case where the carriage 21 and the needle tube 33 are coupled via the elastic body 352, it is possible to make it difficult for the tip end position P33 of the needle tube 33 with respect to the carriage 21 to change in a direction perpendicular to the direction of the axis A3. Therefore, the contact position of the needle tube 33 with the sealing film 94 can be further stabilized.

2. Second Embodiment

Figure 12:
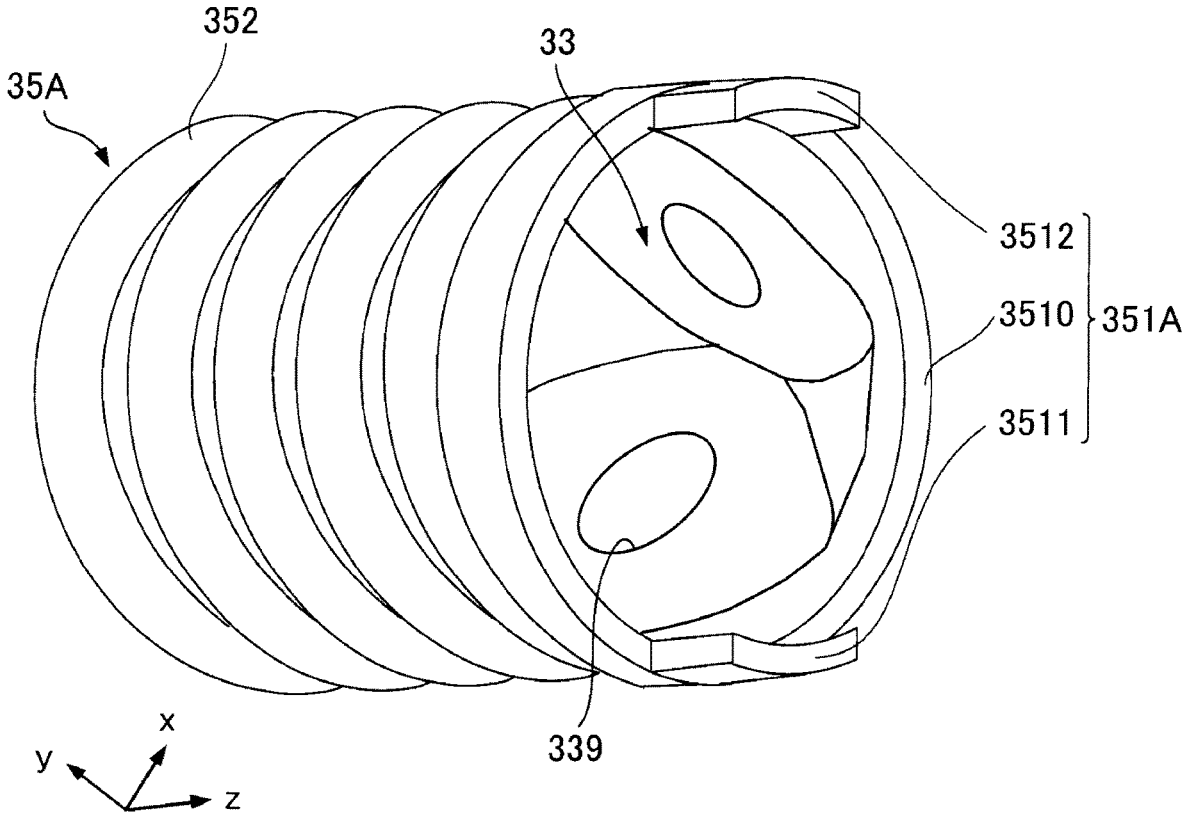
FIG. 12 is a perspective view of an needle tube and an outer peripheral member of the second embodiment.
Figure 13:
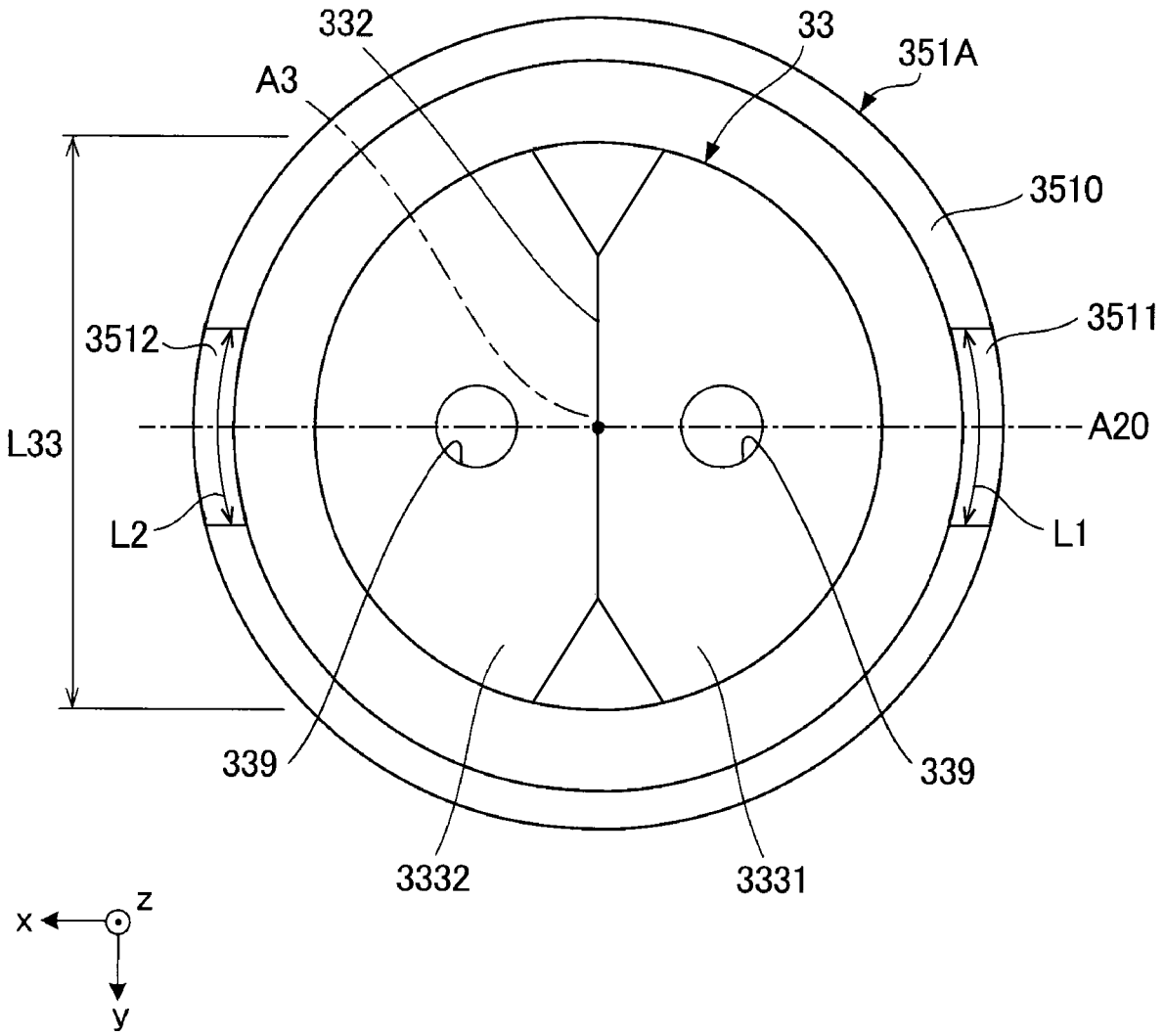
FIG. 13 is a plan view of the needle tube and the outer peripheral member of the second embodiment.

FIG. 12 is a perspective view of the needle tube 33 and an outer peripheral member 35A in the second embodiment. FIG. 13 is a plan view of the needle tube 33 and the outer peripheral member 35A in the second embodiment. This embodiment is different from the first embodiment in terms of the configuration in which an annular member 351A is included in the outer peripheral member 35A. Further, in the second embodiment, the same elements as those in the first embodiment are designated by the same reference signs as used in the description of the first embodiment, and detailed descriptions thereof are omitted as appropriate.

The annular member 351A included in the outer peripheral member 35A illustrated in FIG. 12 includes a base body 3510 and two protrusions 3511 and 3512. The base body 3510 has an annular shape and is coupled to the elastic body 352. In addition, the protrusion 3511 and the protrusion 3512 protrude from the base body 3510 in the +z direction, respectively.

As illustrated in FIG. 13, the protrusion 3511 and the protrusion 3512 are spaced apart from each other and are disposed with the axis A3 interposed therebetween as viewed from the +z direction. When viewed from the +z direction, a straight line A20 coupling the center of the protrusion 3511 and the center of the protrusion 3512 intersects the ridge line 332 of the needle tube 33. In the drawing, the straight line A20 is perpendicular to the ridge line 332. In addition, the length L1 of the protrusion 3511 and the length L2 of the protrusion 3512 are equal to each other. In addition, the length L1 of the protrusion 3511 and the length L2 of the protrusion 3512 are shorter than the length L33 of the ridge line 332.

As described above, the annular member 351A includes the base body 3510 and the protrusions 3511 and 3512 that protrude from the base body 3510 in a direction away from the base end of the needle tube 33. The protrusion 3511 and the protrusion 3512 sandwich the axis A3 of the needle tube 33 when viewed from the direction of the axis A3. One of the protrusion 3511 and the protrusion 3512 is a "first protrusion", and the other is a "second protrusion". According to the annular member 351A, since the protrusion 3511 and the protrusion 3512 are provided, the region between the protrusion 3511 and the protrusion 3512 in the sealing film 94 as viewed from the direction of the axis A3 can be stretched. Therefore, it becomes easier to form the starting point of the tearing of the sealing film 94 by the needle tube 33 between the protrusion 3511 and the protrusion 3512 when viewed from the direction of the axis A3. As a result, the sealing film 94 can be torn as expected, and problems due to torn pieces of the sealing film 94 can be suppressed.

In addition, as described above, the tip end of the needle tube 33 has the ridge line 332. As described above, when viewed from the direction of the axis A3, the straight line A20 coupling the center of the protrusion 3511 and the center of the protrusion 3512 intersects the ridge line 332. For this reason, since tension in a direction perpendicular to the direction in which the ridge line 332 of the needle tube 33 extends is applied to the sealing film 94, the sealing film 94 is easily torn by the needle tube 33. As a result, it becomes easier to stabilize the cutting position of the sealing film 94.

In addition, the longitudinal directions of the protrusion 3511 and the protrusion 3512 are substantially parallel to the direction in which the ridge line 332 extends. For this reason, the region where the sealing film 94 will be in a state of tension, which is easy to tear with the needle tube 33, can be widened. As a result, the cutting position of the sealing film 94 can be further stabilized.

3. Third Embodiment

Figure 14:
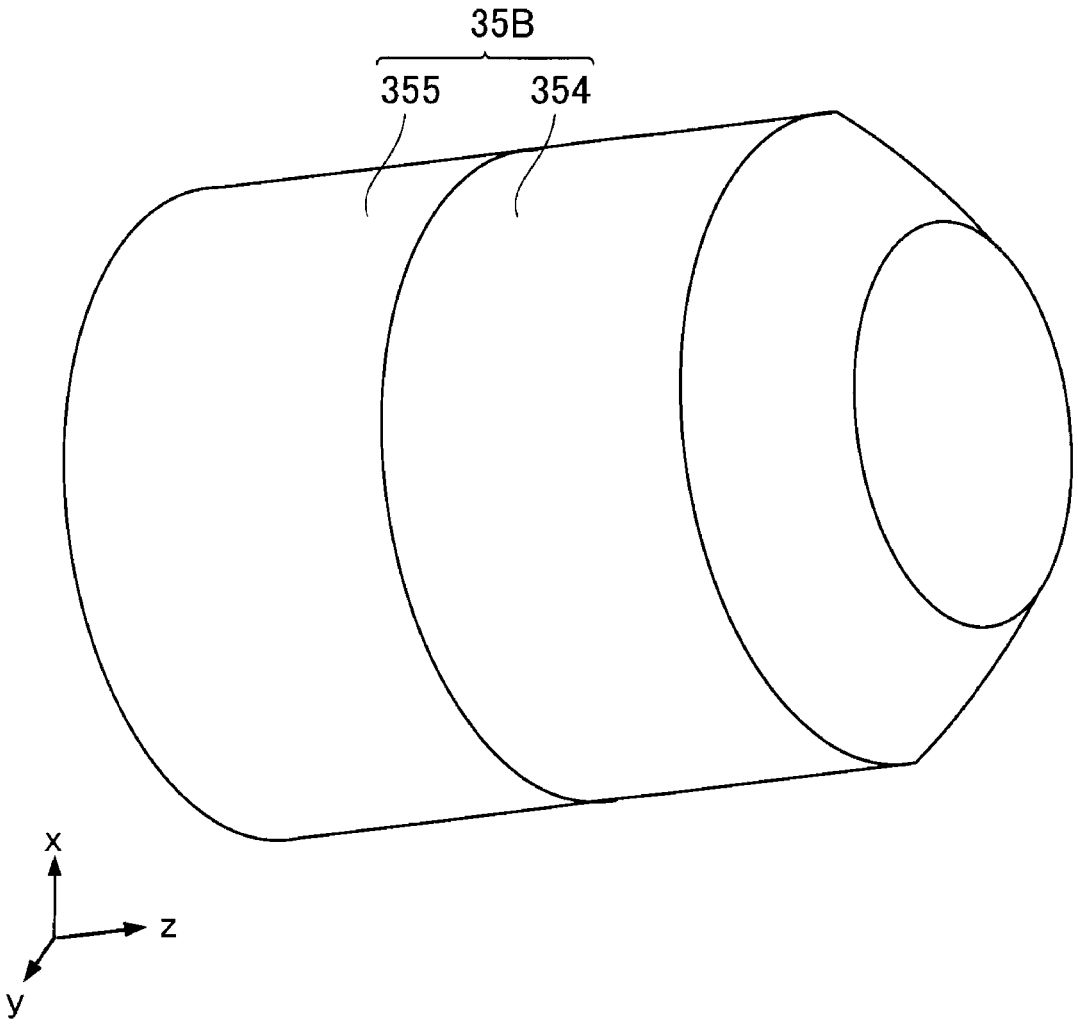
FIG. 14 is a perspective view of an outer peripheral member of a third embodiment.
Figure 15:
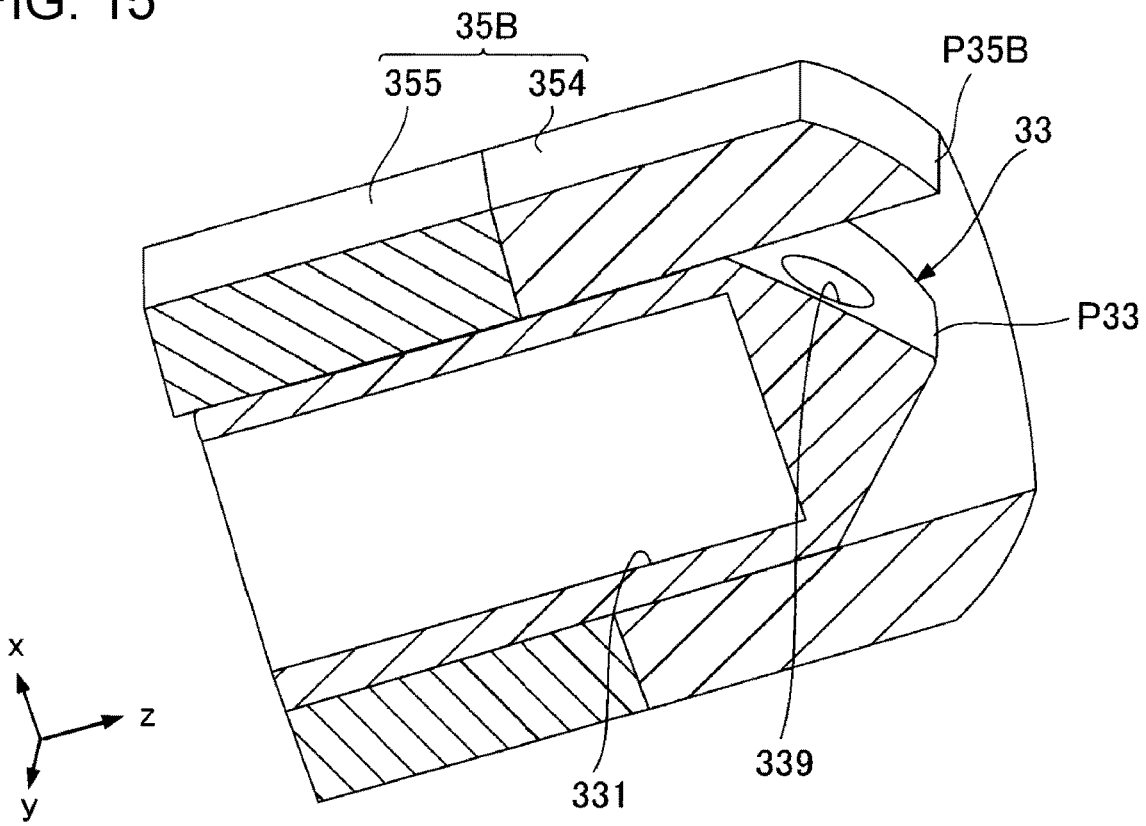
FIG. 15 is a sectional view of an needle tube and the outer peripheral member of the third embodiment.
Figure 16:
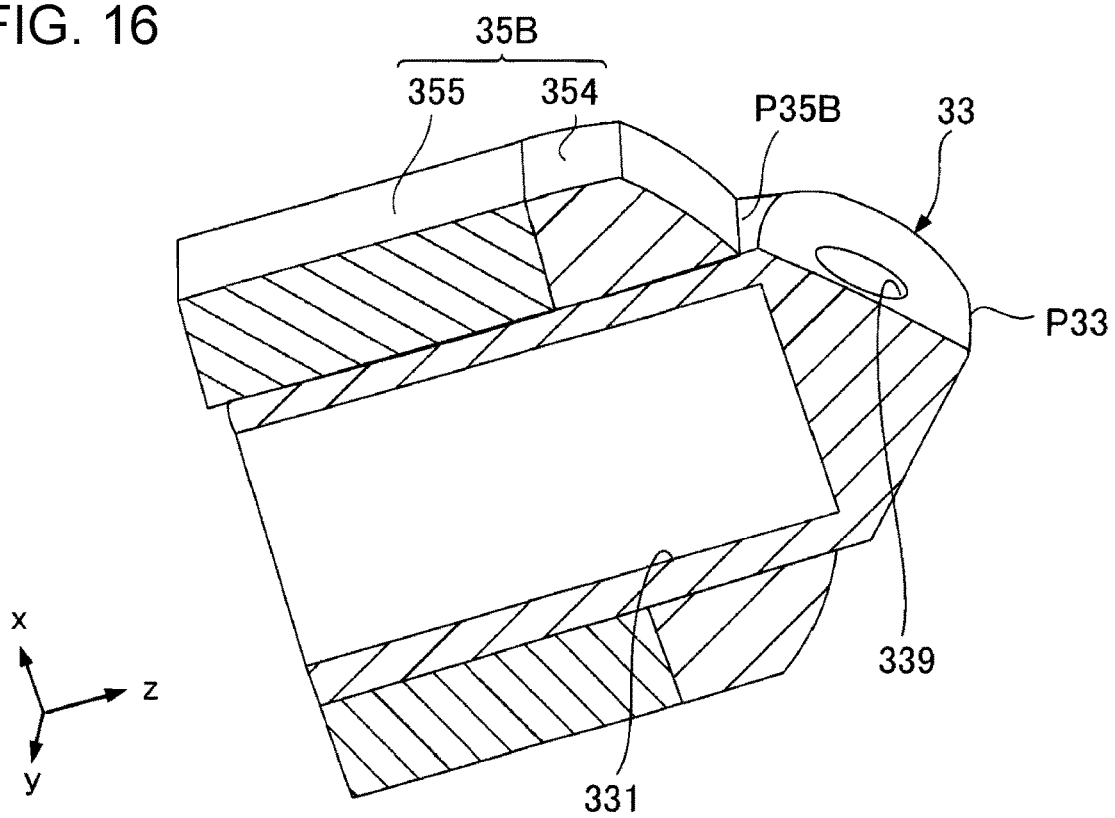
FIG. 16 is a sectional view of the needle tube and the outer peripheral member of the third embodiment.

FIG. 14 is a perspective view of an outer peripheral member 35B of a third embodiment. FIGS. 15 and 16 are sectional views of the needle tube 33 and the outer peripheral member 35B of the second embodiment. In the present embodiment, the configuration of the outer peripheral member 35B is different from that of the first embodiment. Further, in the third embodiment, the same elements as those in the first embodiment are designated by the same reference signs as used in the description of the first embodiment, and detailed descriptions thereof are omitted as appropriate.

The outer peripheral member 35B illustrated in FIG. 14 includes a foam material 354 and a support body 355. The support body 355 couples the base body 31 and the foam material 354 and supports the foam material 354 with respect to the base body 31. The support body 355 is formed of, for example, a metal material or a resin material. The foam material 354 is a porous body having elasticity. The foam material 354 functions as an "protrusion" and a "deformed portion". The foam material 354 is formed of a foamed material such as polyethylene foam, polypropylene foam, or polyurethane foam.

The foam material 354 is deformed by applying a compressive load. FIG. 15 illustrates a state in which no compressive load is applied to the foam material 354. In this state, the tip end position P35B of the foam material 354 is located closer to the +z axis side than is the tip end position P33 of the needle tube 33. Therefore, the foam material 354 can come into contact with the sealing film 94 before the needle tube 33 when the cartridge 9 is mounted on the carriage 21. On the other hand, FIG. 16 illustrates a state in which a compressive load is applied to the foam material 354. By applying the compressive load, the foam material 354 is crushed in the direction of the axis A3 of the needle tube 33. In this state, the tip end position P35B of the foam material 354 is located closer to the −z axis side than is the tip end position P33 of the needle tube 33. Therefore, when the cartridge 9 is mounted on the carriage 21, the needle tube 33 can tear the sealing film 94 without being blocked by the foam material 354.

As described above, the outer peripheral member 35B includes the foam material 354. The "protrusion" and the "elastic member" are integrally formed of the foam material 354. It is possible to change the relative positional relationship between the tip end position P35B and the tip end position P33, as in the first embodiment, also by the deformation of the foam material 354. By using the foam material 354, it is possible to realize the outer peripheral member 35B that can stabilize the cutting position of the sealing film 94 with a simple configuration.

Further, the outer peripheral member 35B is in contact with the needle tube 33, but the outer peripheral member 35B may be separated from the needle tube 33. In addition, the outer peripheral member 35B may have a configuration in which the support body 355 is omitted. That is, the outer peripheral member 35B may be composed of only the foam material 354.

4. Fourth Embodiment

Figure 17:
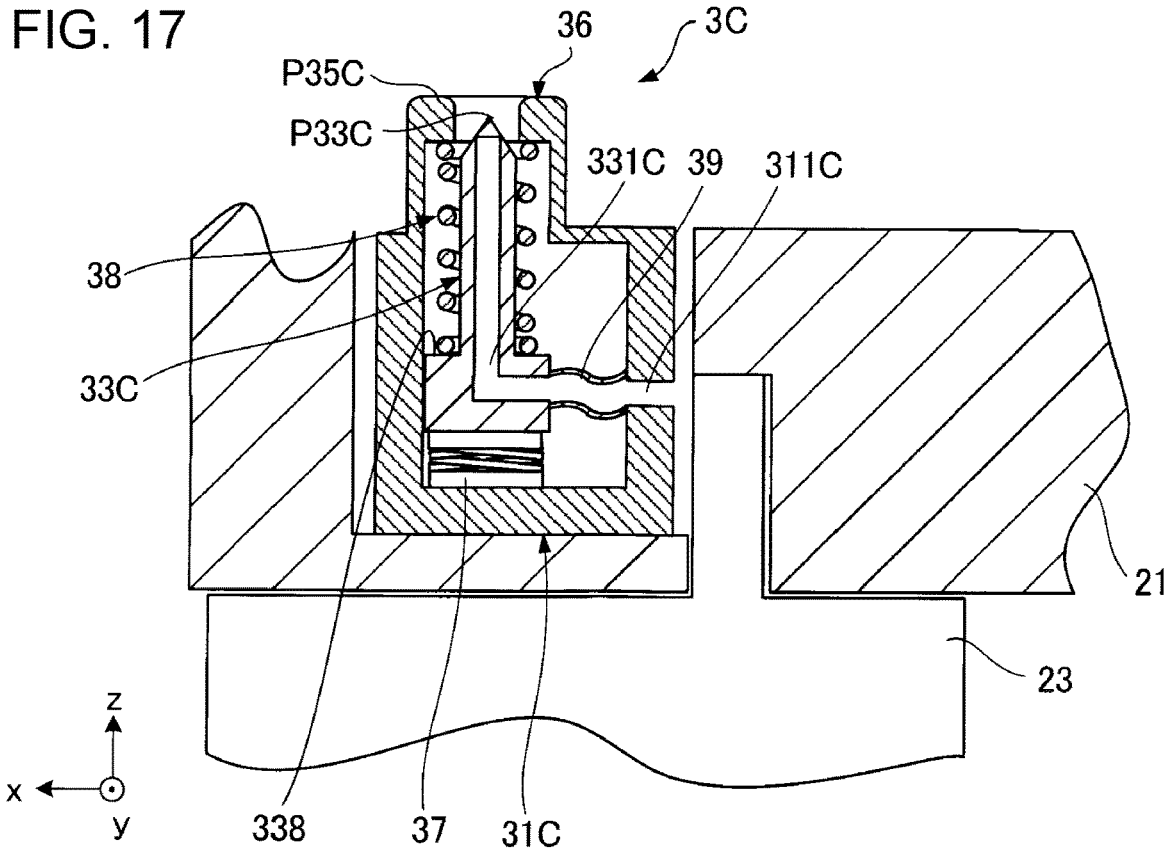
FIG. 17 is a sectional view of an ink supply unit of a fourth embodiment.
Figure 18:
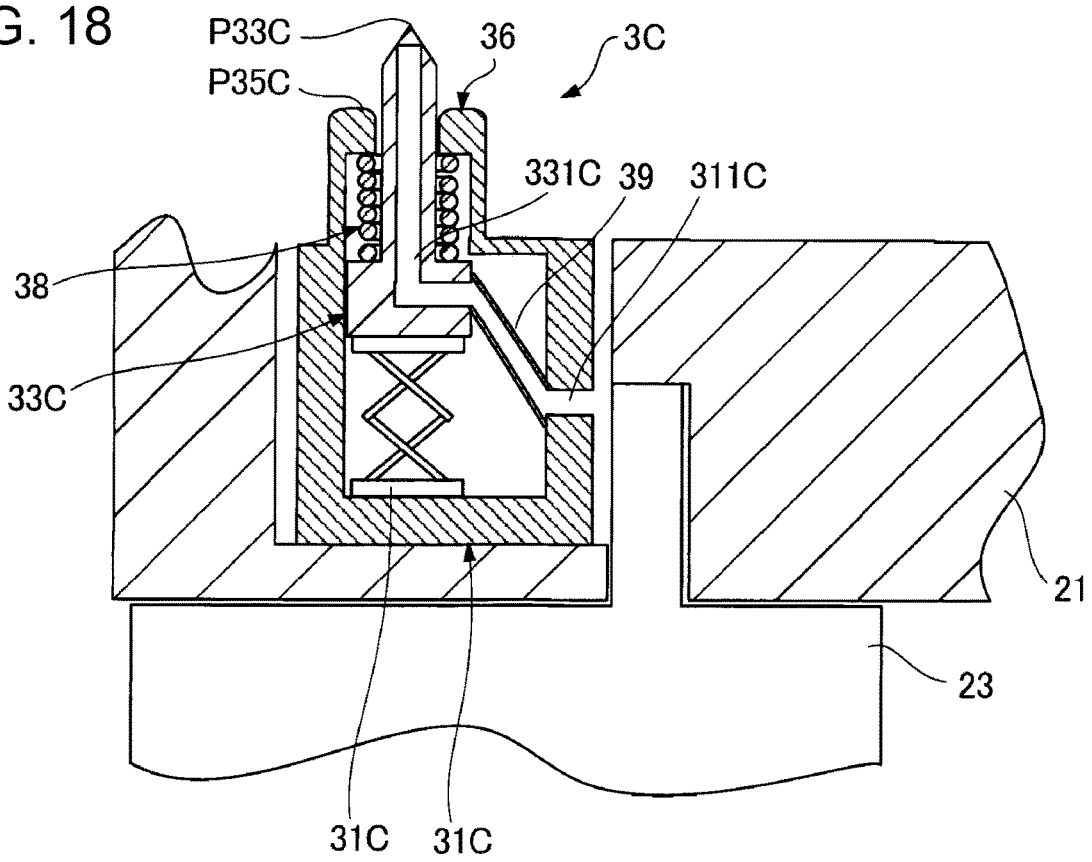
FIG. 18 is a sectional view of the ink supply unit of the fourth embodiment.

FIGS. 17 and 18 are sectional views of an ink supply unit 3C in the fourth embodiment. In the present embodiment, the configuration of the ink supply unit 3C is different from that of the first embodiment. Further, in the fourth embodiment, the same elements as those in the first embodiment are designated by the same reference signs as used in the description of the first embodiment, and detailed descriptions thereof are omitted as appropriate.

The ink supply unit 3C illustrated in FIG. 17 includes a base body 31C, an needle tube 33C, a protruding portion 36, a lock mechanism 37, and an elastic body 38.

The base body 31C is a casing that can house the needle tube 33C. The base body 31C is formed of, for example, a metal material or a resin material. The base body 31C has a flow path 311C that supplies ink supplied from the needle tube 33C to the print head 23.

The base body 31C is provided with the protruding portion 36 that protrudes from the base body 31C. The protruding portion 36 is an example of an "protrusion". The protruding portion 36 has a cylindrical shape and is configured so that the needle tube 33C can be inserted therethrough.

The lock mechanism 37 is disposed in the base body 31C. The needle tube 33C is disposed on the +z axis side of the lock mechanism 37. The lock mechanism 37 can be switched between a locked state in which the needle tube 33C is housed in the base body 31C and a released state in which the locked state is released. Although not illustrated, the lock mechanism 37 has a switch for switching from the locked state to the released state by contact with a predetermined portion of the cartridge 9.

The needle tube 33C is disposed on the lock mechanism 37. The needle tube 33C has an ink flow path 331C. The ink flow path 331C communicates with the flow path 311C of the base body 31C via a tube 39. In addition, the outer periphery of the needle tube 33C has a stepped portion 338. The elastic body 38 is disposed between the stepped portion 338 and the protruding portion 36. The elastic body 38 is an example of a "elastic member". The elastic body 38 is constituted by a tension coil spring and is elastically deformed when a tensile load is applied.

The needle tube 33C is movable in the direction of the axis A3 of the needle tube 33 with the deformation of the elastic body 38. FIG. 17 illustrates the locked state of the lock mechanism 37 described above, in which a tensile load is applied to the elastic body 38. In this state, the tip end position P35C of the protruding portion 36 is located closer to the +z axis side than is the tip end position P33C of the needle tube 33C. Therefore, when the cartridge 9 is mounted on the carriage 21, the protruding portion 36 can come into contact with the sealing film 94 before the needle tube 33C does. On the other hand, FIG. 18 illustrates a state in which the lock mechanism 37 has been released, and a compression load is not being applied to the elastic body 352. In this state, the leading end position P35C of the protruding portion 36 is located closer to the −z axis side than is the leading end position P33C of the needle tube 33C. Therefore, when the cartridge 9 is mounted on the carriage 21, the needle tube 33C can tear the sealing film 94 without being obstructed by the protruding portion 36.

In the present embodiment, the elastic body 38 couples the needle tube 33C and the protruding portion 36. The needle tube 33C is movable relative to the carriage 21 by the elastic body 38. Also with the ink supply unit 3C having such a configuration, the sealing film 94 can be in a stretched state due to the protruding portion 36, and the needle tube 33C can be brought into contact with the sealing film 94 in the stretched state. Therefore, it is possible to suppress problems caused by torn pieces of the sealing film 94.

5. Fifth Embodiment

Figure 19:
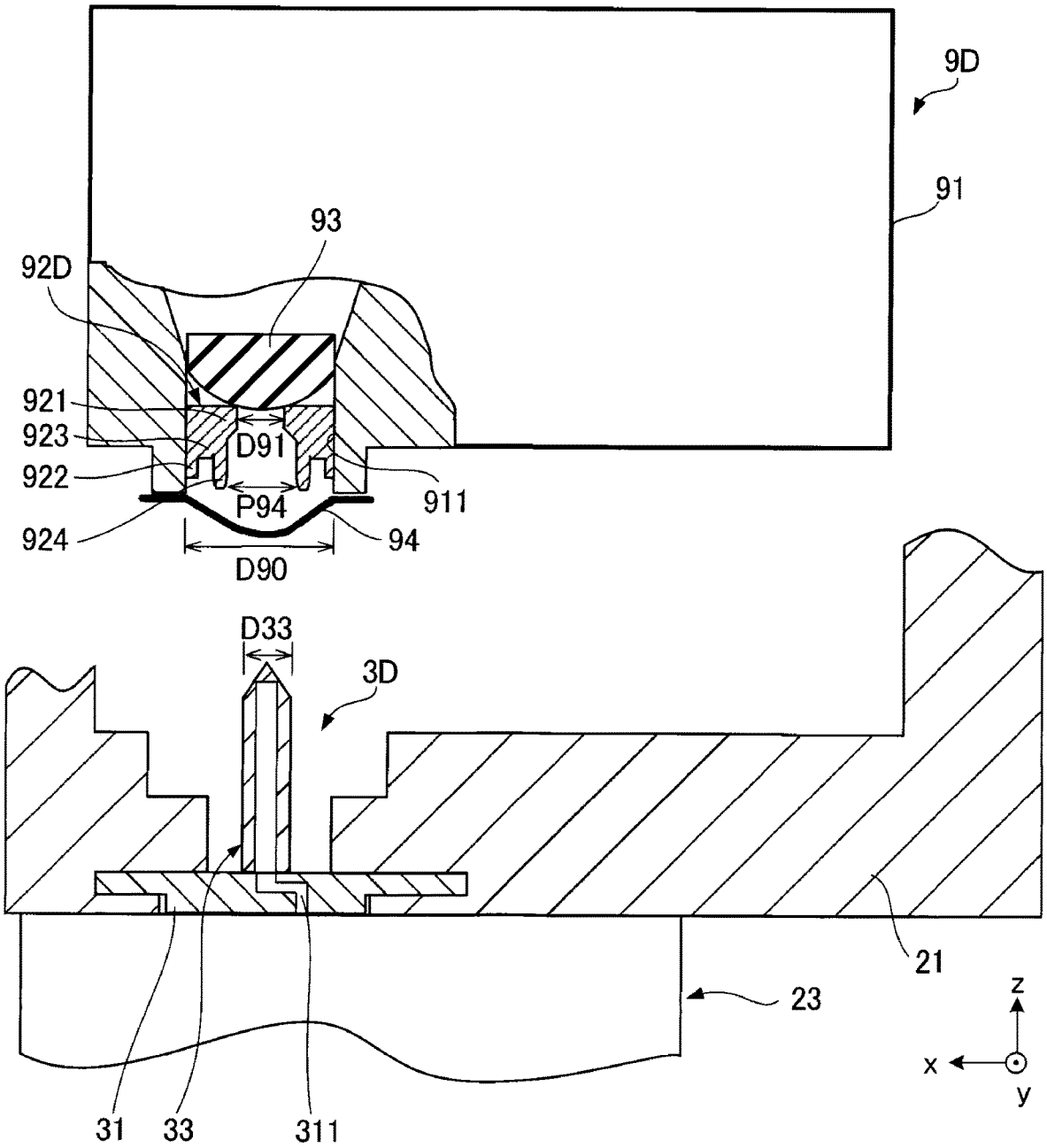
FIG. 19 is a sectional view of a cartridge and an ink supply unit of a fifth embodiment.
Figure 20:
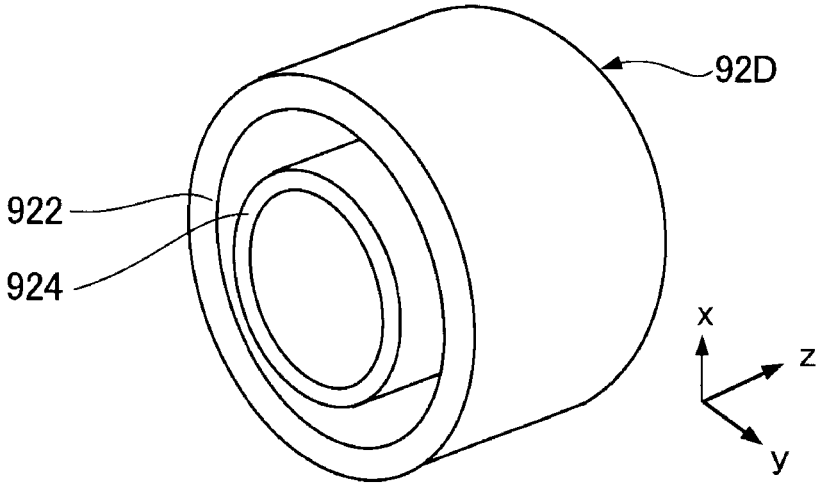
FIG. 20 is a perspective view of an elastic member included in the cartridge of the fifth embodiment.
Figure 21:
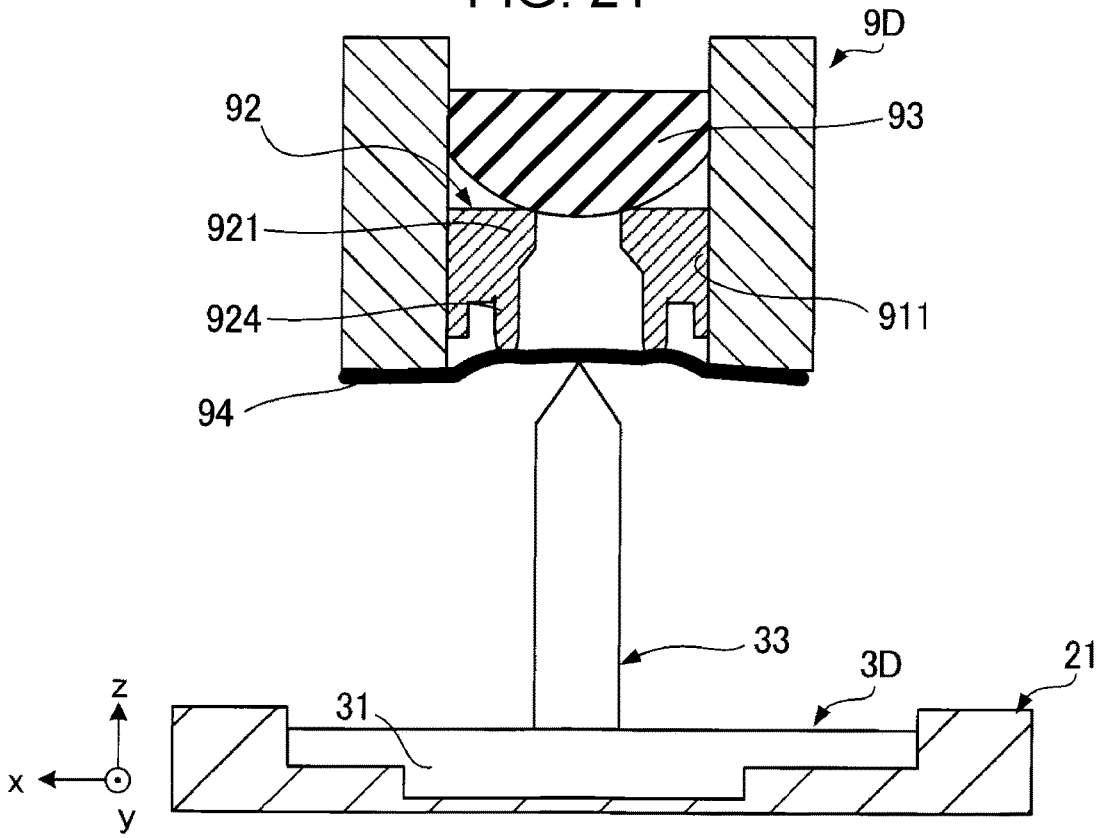
FIG. 21 is a sectional view for explaining mounting of the cartridge on the carriage of the fifth embodiment.
Figure 22:
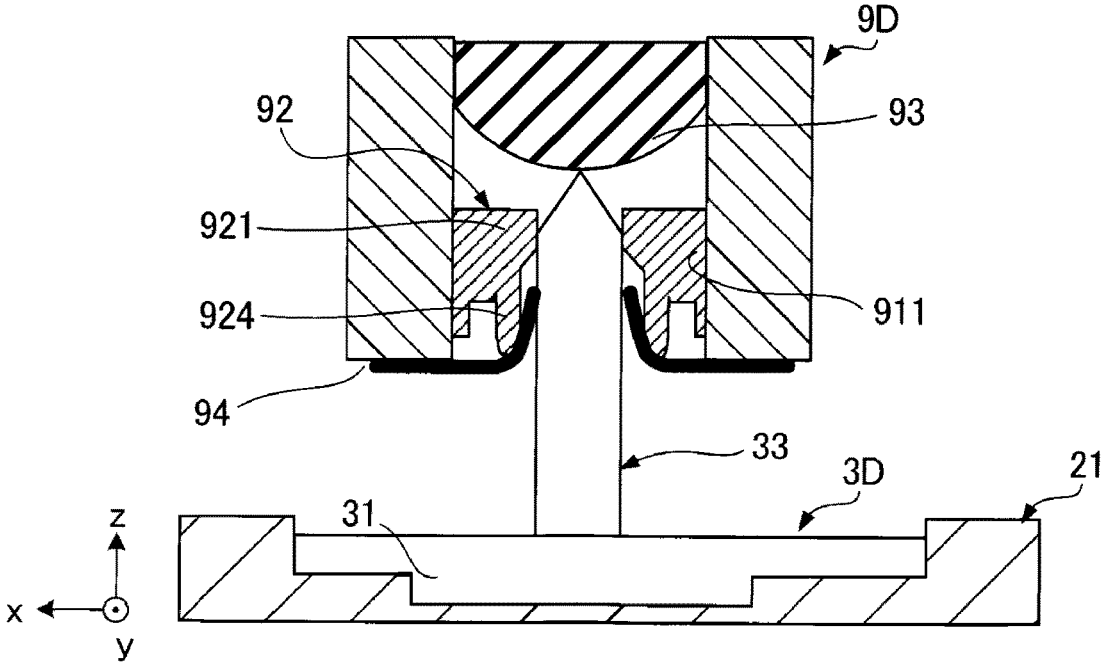
FIG. 22 is a sectional view for explaining the mounting of the cartridge on the carriage of the fifth embodiment.

FIG. 19 is a perspective view of a cartridge 9D and an ink supply unit 3D of a fifth embodiment. FIG. 20 is a sectional view of an elastic member 92D included in the cartridge 9D according to the fifth embodiment. FIGS. 21 and 22 are sectional views for explaining the mounting of the cartridge 9D on the carriage 21 in the fifth embodiment. This embodiment is different from the first embodiment in terms of the configuration of the cartridge 9D and the ink supply unit 3D. Further, in the fifth embodiment, the same elements as those in the first embodiment are designated by the same reference signs as used in the description of the first embodiment, and detailed descriptions thereof are omitted as appropriate.

As illustrated in FIG. 19, the elastic member 92D included in the cartridge 9D includes a protruding portion 924 that protrudes from the first portion 921 toward the −z direction side. As illustrated in FIG. 20, the protruding portion 924 has an annular shape. The tip end surface of the protruding portion 924 is planar and protrudes further toward the −z direction side than does the tip end surface of the second portion 922. The protruding portion 924 is an example of an "annular portion". In addition, as illustrated in FIG. 19, the opening width D94 of the protruding portion 924 is larger than the opening width D91 of the first portion 921.

The ink supply unit 3D includes the base body 31 and the needle tube 33. In the ink supply unit 3D, the outer peripheral member 35 of the first embodiment is omitted.

From the state of the cartridge 9 illustrated in FIG. 19, when the cartridge 9 is moved in the −z direction to be mounted on the carriage 21, the needle tube 33 comes into contact with the sealing film 94 as illustrated in FIG. 19. At this time, the sealing film 94 is pressed by the needle tube 33 and contacts the protruding portion 924. By this contact, the sealing film 94 is in a state where it is supported at three points by the needle tube 33 and the protruding portion 924. In addition, when the protruding portion 924 contacts the sealing film 94, a tension is generated in the sealing film 94.

As the sealing film 94 is stretched as illustrated in FIG. 21, the cartridge 9D is further moved in the −z direction, whereby the sealing film 94 is torn by the needle tube 33 as illustrated in FIG. 22.

As described above, the cartridge 9D can be mounted on the printer 1 including the needle tube 33 having the ink flow path 331 into which the ink is introduced. The cartridge 9D includes the ink container 91 that houses ink and that is provided with the opening portion 911 through which the needle tube 33 can be inserted, and the sealing film 94 disposed outside the opening portion 911 and sealing the opening portion 911. In addition, the cartridge 9D includes the first portion 921 that is disposed inside the opening portion 911 and serves as an annular "supporting portion" in which the needle tube 33 is inserted and supported. Furthermore, the cartridge 9D is disposed in a region between the first portion 921 and the sealing film 94 inside the opening portion 911, and includes the protruding portion 924 that is annular and that has an opening width D94 larger than the opening width D91 of the first portion 921.

Since the protruding portion 924 is provided, tension can be generated in the sealing film 94 when the sealing film 94 is torn by the needle tube 33. For this reason, since the contact position of the needle tube 33 on the sealing film 94 can be stabilized, problems due to torn pieces of the sealing film 94 can be suppressed. In addition, the opening width D94 of the protruding portion 924 is larger than the opening width D91 of the first portion 921 in which the needle tube 33 is inserted and supported. For this reason, the opening width D94 of the protruding portion 924 is larger than the width D33 of the needle tube 33. For this reason, the needle tube 33 can lead out the ink without being obstructed by the protruding portion 924. In addition, a groove is provided between the protruding portion 924 and the second portion 922, and the protruding portion 924 can be deformed when a deviation occurs in the contact position of the needle tube 33.

Further, in this embodiment, the front end surface of the protruding portion 924 protrudes farther toward the −z axis than does the front end surface of the second portion 922, but may be located closer to the +z axis side than is the front end surface of the second portion 922.

6. Modifications

Each embodiment exemplified above can be variously modified. Specific modifications that can be applied to each of the above-described embodiments are given below. Two or more examples arbitrarily chosen from the following examples can be combined appropriately as long as they do not contradict each other.

6-1. First Modification

Figure 23:
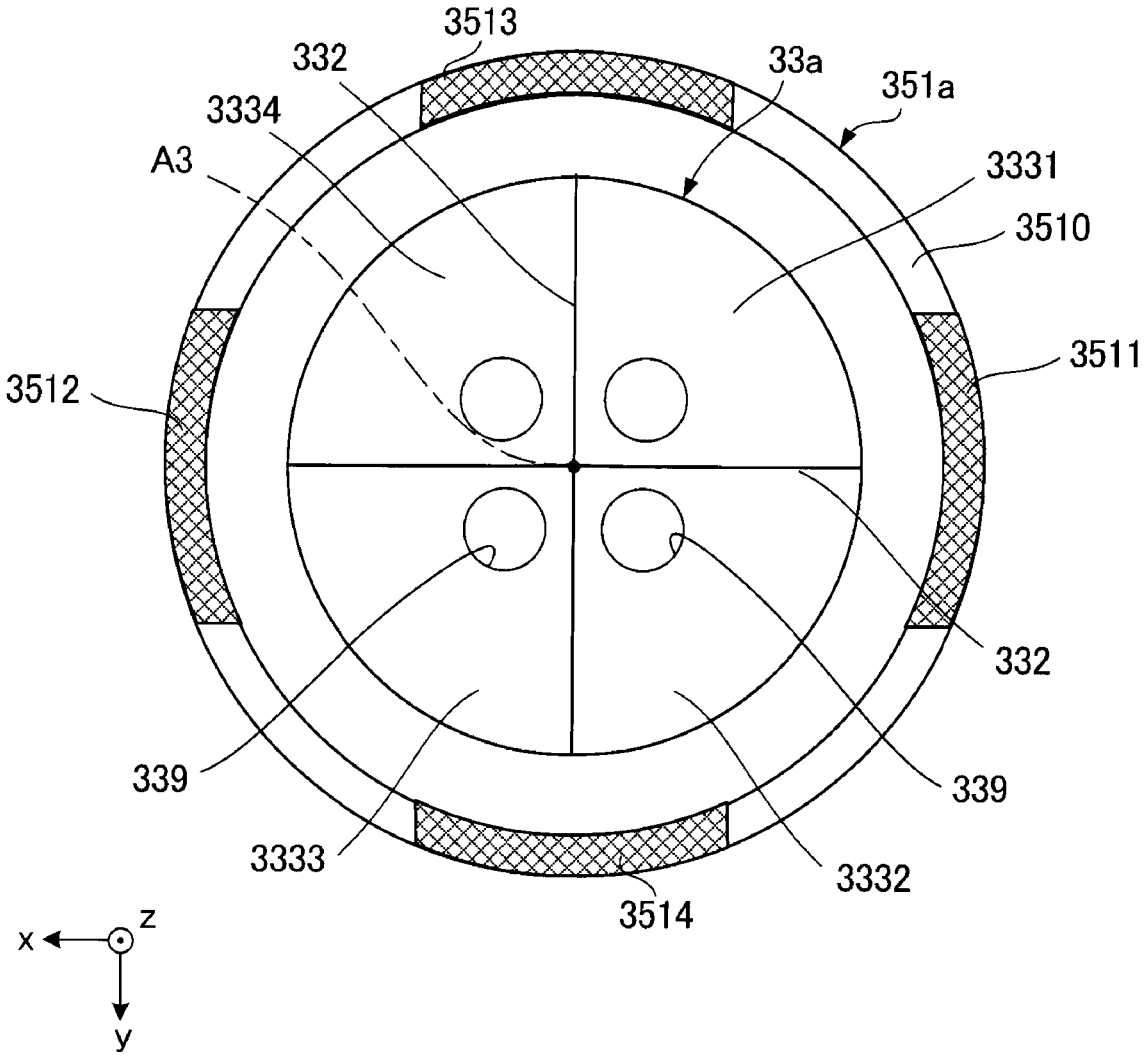
FIG. 23 is a plan view of an needle tube and an annular member of a first modification.

Although the annular member 351A of the second embodiment includes the two protrusions 3511 and 3512, the number of "protrusions" is not limited thereto. FIG. 23 is a plan view of the needle tube 33 and an annular member 351*a* of a first modification. The annular member 351*a* of the first modification has four protrusions 3511, 3512, 3513, and 3514. In addition, the four protrusions 3511, 3512, 3513, and 3514 are provided at equal intervals along the circumferential direction of the needle tube 33. In addition, the protrusion 3513 and the protrusion 3514 are disposed with the axis A3 interposed therebetween as viewed from the +z direction. The annular member 351*a* such as that described above also facilitates tearing of the sealing film 94 as expected. In this modification, one of the protrusion 3513 and the protrusion 3514 may be a "first protrusion" and the other may be a "second protrusion".

Further, an needle tube 33*a* has four inclined surfaces 3331, 3332, 3333, and 3334. The coupling portion of the four inclined surfaces 3331, 3332, 3333, and 3334 is the tip end of the needle tube 33*a* and is located on the axis A3 of the needle tube 33*a*.

6-2. Second Modification

Figure 24:
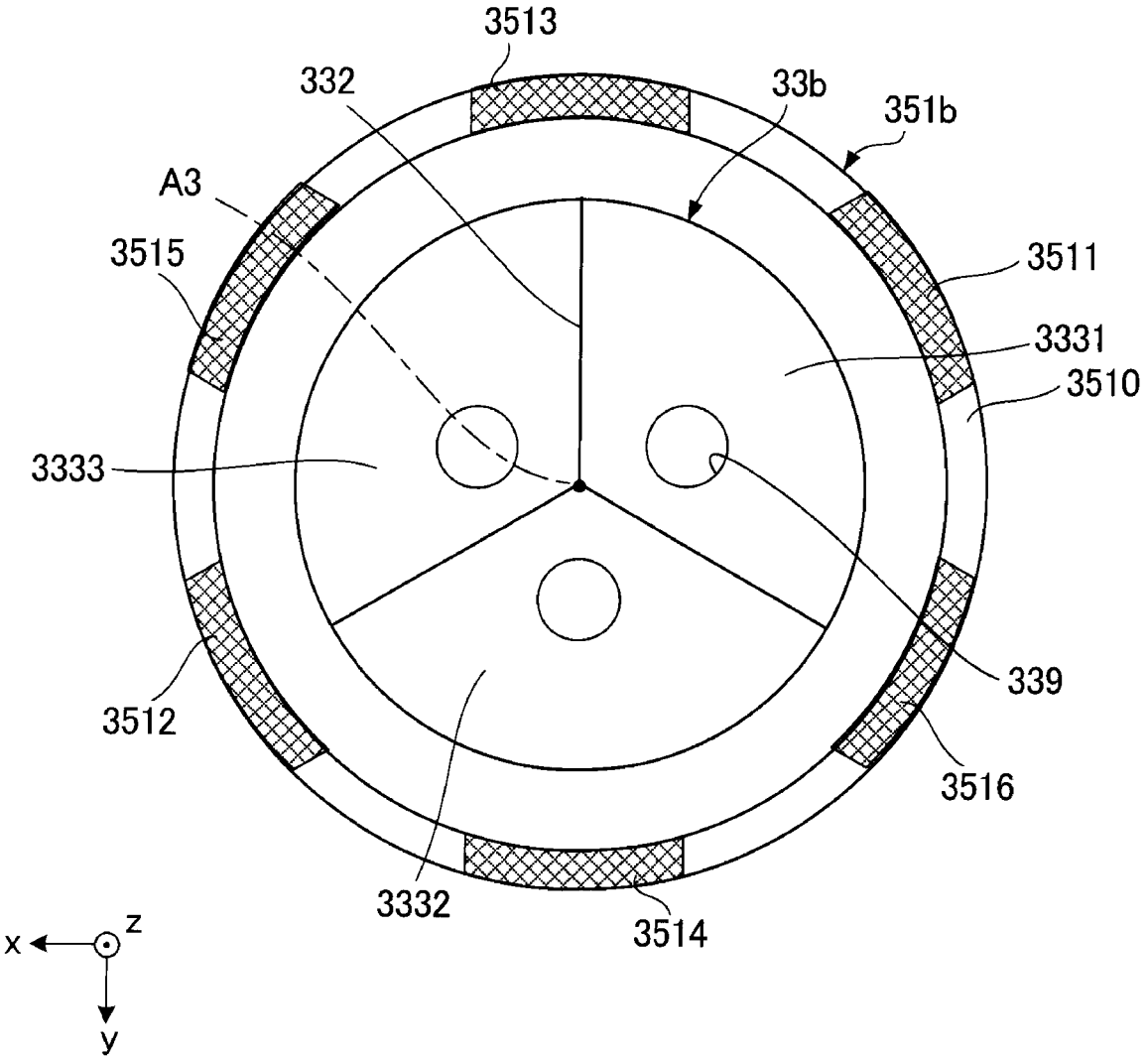
FIG. 24 is a plan view of an needle tube and an annular member of a second modification.

FIG. 24 is a plan view of the needle tube 33 and an annular member 351*b* of a second modification. The annular member 351*b* of the second modification has six protrusions 3511, 3512, 3513, 3514, 3515, and 3516. In addition, the six protrusions 3511, 3512, 3513, 3514, 3515, and 3516 are provided at equal intervals along the circumferential direction of the needle tube 33. In addition, the protrusion 3515 and the protrusion 3516 are arranged with the axis A3 interposed therebetween as viewed from the +z direction. The annular member 351*b* such as that described above also makes it easy to tear the sealing film 94 at an expected position. In this modification, one of the protrusion 3513 and the protrusion 3514 may be a "first protrusion" and the other may be a "second protrusion". In addition, one of the protrusion 3515 and the protrusion 3516 may be a "first protrusion", and the other may be a "second protrusion".

Further, an needle tube 33*b* has three inclined surfaces 3331, 3332, and 3333. The coupling portion of the three inclined surfaces 3331, 3332, and 3333 is located at the tip end of the needle tube 33*b* and on the axis A3 of the needle tube 33*b*.

6-3. Third Modification

Figure 25:
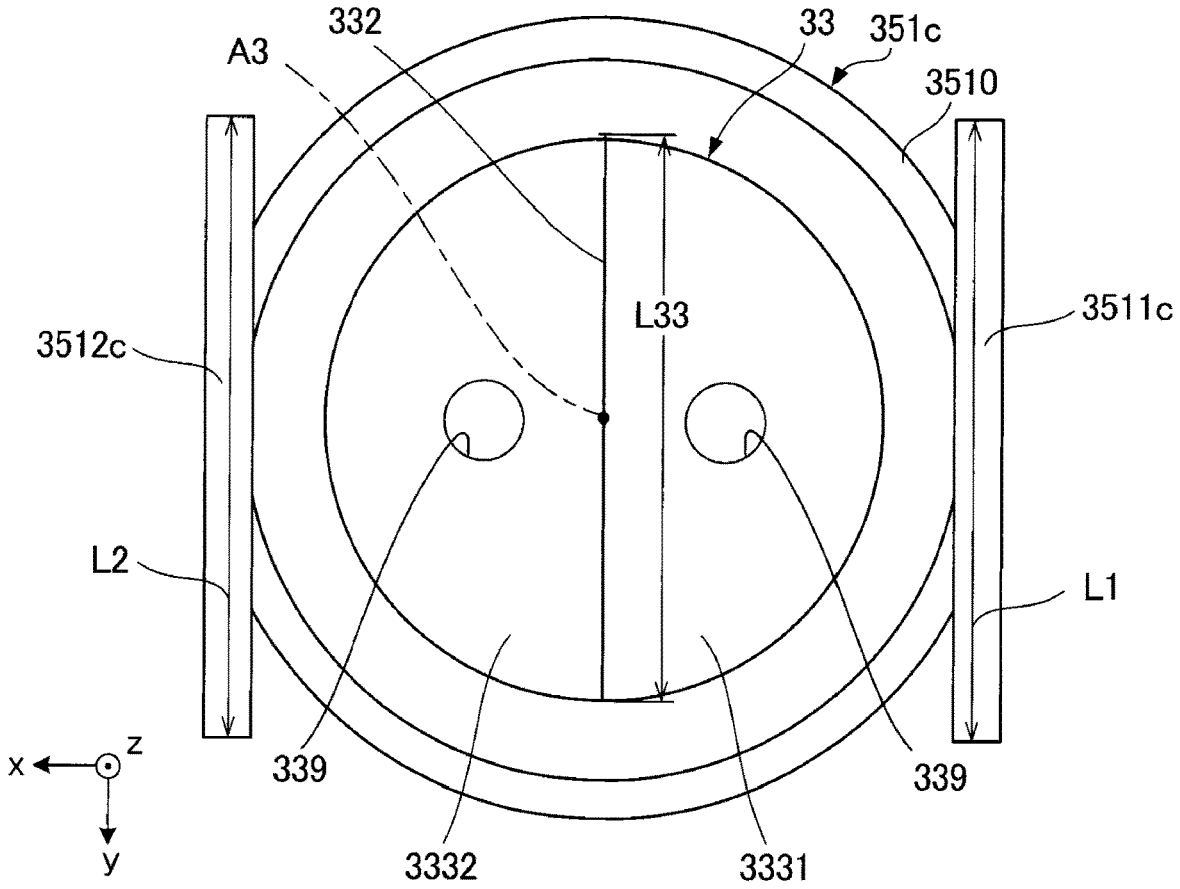
FIG. 25 is a plan view of an needle tube and an annular member of a third modification.

FIG. 25 is a plan view of the needle tube 33 and an annular member 351*c* of a third modification. The annular member 351*c* has two protrusions 3511*c* and 3512*c*. The length L1 of the protrusion 3511 and the length L2 of the protrusion 3512 are respectively longer than the length L33 of the ridge line 332. The length L1 and the length L2 are lengths in a direction along the ridge line 332. By bringing the two protrusions 3511*c* and 3512*c* into contact with the sealing film 94, the region between the protrusions 3511*c* and 3512*c* of the sealing film 94 can be stretched. Therefore, since the length L1 and the length L2 are each longer than the length L33, when the sealing film 94 is torn by the needle tube 33, the entirety of the ridge line 332 contacts the stretched region of the sealing film 94. Therefore, the cutting position of the sealing film 94 can be made more stable than when the length L1 and the length L2 are each shorter than the length L33.

One of the protrusion 3511 and the protrusion 3512 is a "first protrusion", and the other is a "second protrusion". When the protrusion 3511 is the "first protrusion" and the protrusion 3512 is the "second protrusion", the length L1 corresponds to a "first length" and the length L2 corresponds to a "second length".

In addition, the longitudinal directions of the protrusion 3511 and the protrusion 3512 are parallel to the direction in which the ridge line 332 extends. For this reason, compared with the case where the longitudinal directions of the protrusion 3511 and the protrusion 3512 are not parallel to the direction in which the ridge line 332 extends, the cutting position of the sealing film 94 can be stabilized more.

6-4. Fourth Modification

Figure 26:
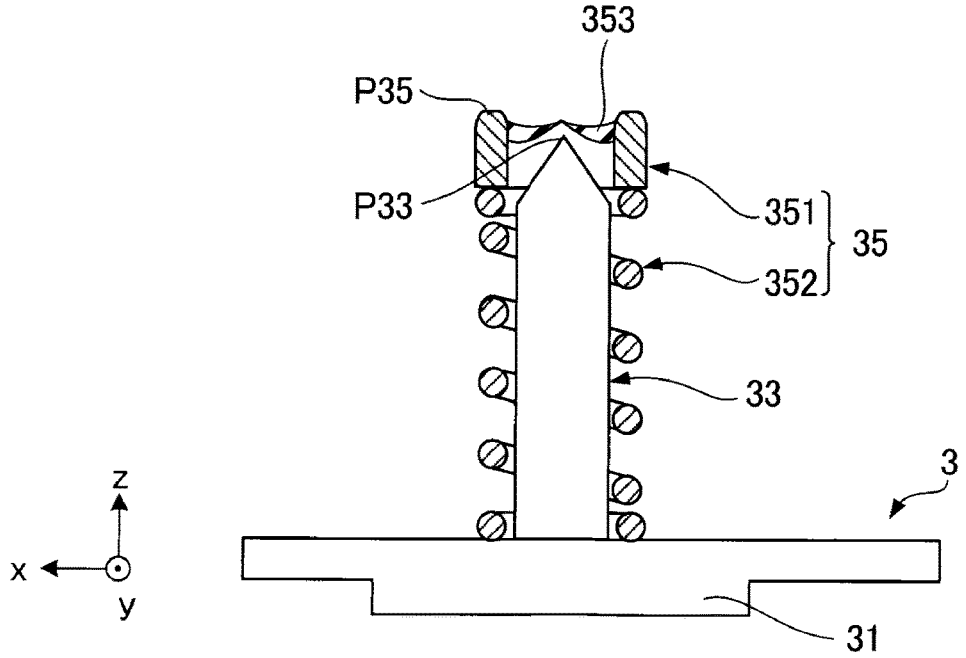
FIG. 26 is a sectional view illustrating a valve body included in an ink supply unit of a fourth modification.

FIG. 26 is a sectional view illustrating a valve body 353 of a fourth modification. The valve body 353 for preventing the ink attached to the needle tube 33 from drying may be coupled to the annular member 351. When the tip end position P33 of the needle tube 33 is located closer to the base body 31 than is the valve body 353, the valve body 353 is in a closed state as illustrated in FIG. 26. On the other hand, the valve body 353 becomes in an open state by being pressed by the needle tube 33. In this state, the needle tube 33 protrudes from the annular member 351 to the +z axis side. Further, the valve body 353 may be coupled not only to the annular member 351 of the first embodiment, but also to the annular member 351A of the second embodiment, and the foam material 354 in the third embodiment.

6-5. Fifth Modification

Figure 27:
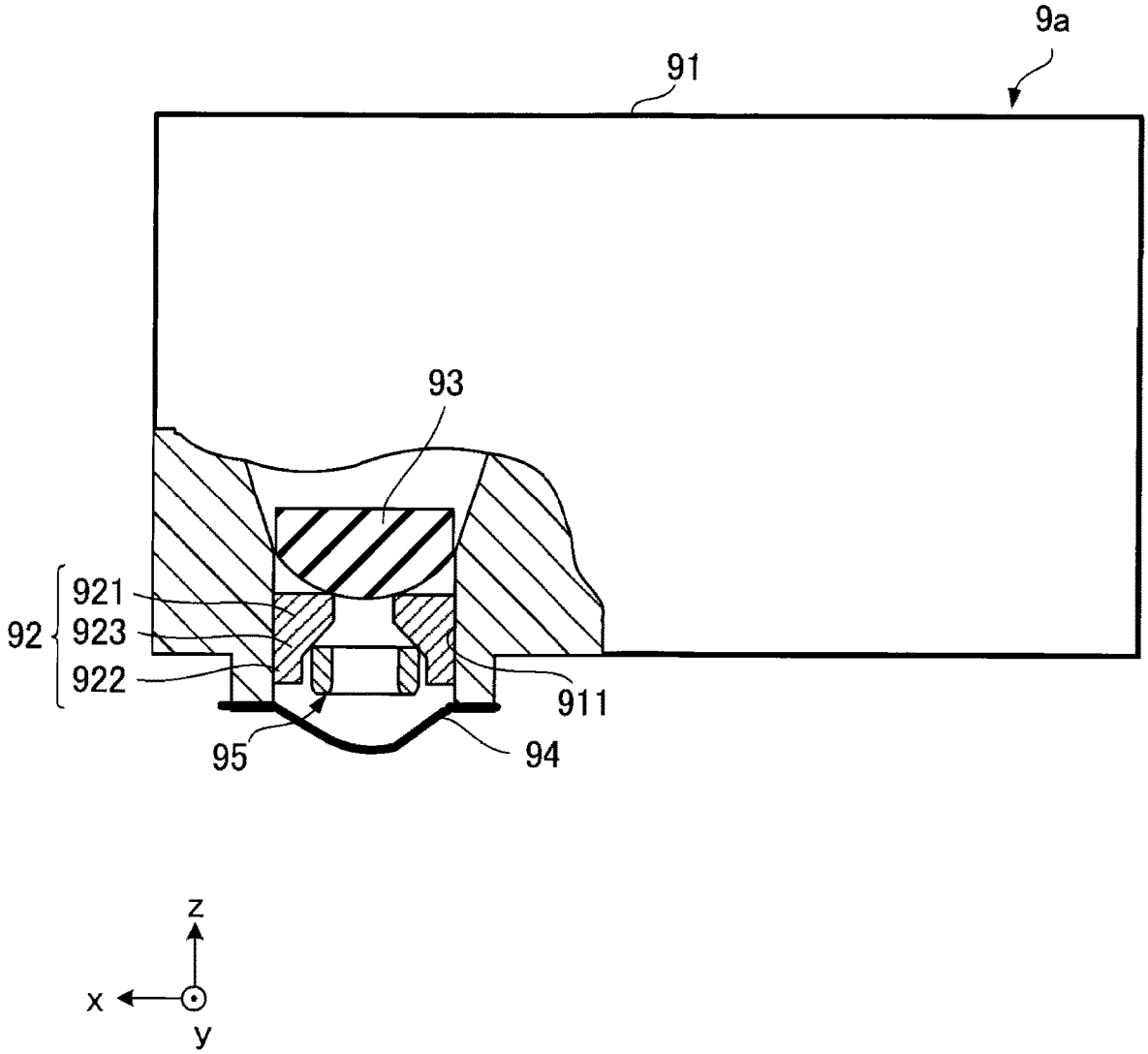
FIG. 27 is a sectional view of a protruding member included in a cartridge of a fifth modification.

In a fifth embodiment, the elastic member 92D and the protruding portion 924 are integrally formed, but they may be separate. FIG. 27 is a sectional view of a protruding member 95 included in a cartridge 9*a* of a fifth modification. As illustrated in FIG. 27, the cartridge 9*a* includes the elastic member 92 and the protruding member 95, which is annular. The protruding member 95 is an example of an "annular portion". The protruding member 95 is supported by the elastic member 92 so as to be movable in the xy plane. The protruding member 95 may be formed of a member having elasticity such as rubber such as isoprene rubber or silicone rubber, or may be formed using a resin material or a metal material.

Since the protruding member 95 is separate from the elastic member 92, deviation of the needle tube 33 from the protruding member 95 in the xy plane is allowed. Consequently, when the cartridge 9 is mounted on the carriage 21, the needle tube 33 can be easily inserted into the protruding member 95 even if the needle tube 33 and the protruding member 95 are displaced in the xy plane. In addition, the protruding member 95 can function as a guide portion that guides the needle tube 33 to the first portion 921. Therefore, the cartridge 9 can be easily mounted on the carriage 21. In addition, it is possible to stabilize the tearing of the sealing film 94 during the mounting.

6-6. Sixth Modification

The elastic body 352 in the first and second embodiments is formed of a compression coil spring, but may be a spring member other than a coil spring such as a leaf spring. In addition, the elastic body 352 may be formed of a rubber such as isoprene rubber or silicone rubber, or any of various thermoplastic elastomers such as polyurethane or polyester. Further, the same applies to the elastic body 38 in the fourth embodiment. In addition, instead of the foam material 354 of the third embodiment, a member formed of a rubber such as isoprene rubber or silicone rubber, or any of various thermoplastic elastomers such as polyurethane or polyester may be used.

6-7. Seventh Modification

The "elastic member" only needs to be deformable by an external force, and is not limited to an elastic member. The "elastic member" may be formed of a link mechanism or the like, for example.

6-8. Eighth Modification

In the first embodiment, the tip end of the needle tube 33 has the ridge line 332, but the tip end of the needle tube 33 need not have the ridge line 332. That is, the tip end of the needle tube 33 may be sharp. In addition, in each practical form, the tip end of the needle tube 33, that is, the sharpest portion of the needle tube 33 need not be on the axis A3 of the needle tube 33. The tip end of the needle tube 33 may be displaced from the center of the needle tube 33 as viewed from the direction of the axis A3.

6-9. Ninth Modification

The "peripheral portion" only needs to be provided around the needle tube 33 as viewed from the direction of the axis A1, and need not be provided over the entire circumference. In other words, it may be provided only partly around the needle tube 33.

As mentioned above, although the present disclosure has been described based on the illustrated embodiments, the present disclosure is not limited thereto. In addition, the configuration of each element of the present disclosure can be replaced by any configuration having the same function of the embodiments mentioned above, and any configuration can be added. In addition, in the present disclosure, any of the configurations of the respective embodiments described above may be combined.

What is claimed is:

1. A printer comprising:

a cartridge holder in which a cartridge that houses ink is mounted;

an needle tube having an ink flow path through which the ink is introduced from the cartridge;

an protrusion disposed around the needle tube as viewed from an axial direction of the needle tube; and a elastic member configured to be deformed by an external force in a direction from a tip end to a base end of the needle tube, wherein the elastic member changes a relative positional relationship between a tip end position of the needle tube and a tip end position of the protrusion from a first state in which the tip end position of the protrusion is located further away from the base end of the needle tube than is the tip end position of the needle tube, to a second state in which the tip end position of the protrusion is closer to the base end of the needle tube than is the tip end position of the needle tube upon being deformed by the external force.

2. The printer according to claim 1, wherein the elastic member is formed of an elastic body.

3. The printer according to claim 1, wherein the protrusion is configured to move with respect to the cartridge by deformation of the elastic member.

4. The printer according to claim 1, wherein the protrusion and the elastic member are integrally formed of a foam material.

5. The printer according to claim 1, wherein the protrusion surrounds an entire circumference of the needle tube when viewed from the axial direction.

6. The printer according to claim 1, wherein the protrusion includes a base, a first protrusion protruding from the base in a direction away from the base end of the needle tube, and a second protrusion protruding from the base in the direction away from the base end of the needle tube, the second protrusion and the first protrusion interposing an axis of the needle tube therebetween when viewed from the axial direction.

7. The printer according to claim 6, wherein the tip end of the needle tube has a ridge line, and, when viewed from the axial direction, a straight line coupling a center of the first protrusion and a center of the second protrusion intersects the ridge line.

8. The printer according to claim 7, wherein when viewed from the axial direction, a first length of the first protrusion in a direction along the ridge line is longer than a length of the ridge line, and a second length of the second protrusion in the direction along the ridge line is longer than the length of the ridge line.

9. A cartridge attachable to a printer having an needle tube having an ink flow path into which ink is introduced, the cartridge comprising:

an ink container that houses the ink and that is provided with an opening portion through which the needle tube is configured to be inserted;

a sealing film disposed outside the opening portion and sealing the opening portion;

an annular support portion that is disposed inside the opening portion and in which the needle tube is inserted and supported; and an annular portion that is disposed in a region between the support portion and the sealing film inside the opening portion and that has an opening width larger than an opening width of the support portion.

* * * * *